US009751600B2

(12) United States Patent
Elliott et al.

(10) Patent No.: US 9,751,600 B2
(45) Date of Patent: Sep. 5, 2017

(54) FINBOX FOR MULTIPLE FIN SYSTEMS

(71) Applicants: David Elliott, San Diego, CA (US); Alex Eyman, Fountain Valley, CA (US); Kyle Kitzmiller, San Diego, CA (US)

(72) Inventors: David Elliott, San Diego, CA (US); Alex Eyman, Fountain Valley, CA (US); Kyle Kitzmiller, San Diego, CA (US)

( * ) Notice: Subject to any disclaimer, the term of this patent is extended or adjusted under 35 U.S.C. 154(b) by 0 days.

(21) Appl. No.: 15/199,941

(22) Filed: Jun. 30, 2016

(65) Prior Publication Data

US 2017/0001693 A1 Jan. 5, 2017

Related U.S. Application Data

(60) Provisional application No. 62/188,298, filed on Jul. 2, 2015.

(51) Int. Cl.
*B63B 1/00* (2006.01)
*B63B 35/00* (2006.01)
*B63B 35/79* (2006.01)

(52) U.S. Cl.
CPC ..... *B63B 35/793* (2013.01)

(58) Field of Classification Search
CPC ... B63B 35/79; B63B 35/7926; B63B 35/793; B63B 2035/79; B63B 35/813
USPC ..... 441/65, 74, 79
See application file for complete search history.

(56) References Cited

U.S. PATENT DOCUMENTS

| | | | | |
|---|---|---|---|---|
| 5,464,359 | A | 11/1995 | Whitty | |
| 5,830,025 | A | 11/1998 | Fleming | |
| 6,764,364 | B1 | 7/2004 | Hickman et al. | |
| 6,896,570 | B1 | 5/2005 | O'Keefe et al. | |
| 6,918,806 | B2 | 7/2005 | Skedeleski | |
| 6,991,504 | B1 | 1/2006 | English et al. | |
| 7,108,571 | B2 | 9/2006 | Geraghty | |
| 7,182,661 | B2 | 2/2007 | Sams et al. | |
| 7,285,031 | B2 | 10/2007 | Mair et al. | |
| 7,497,752 | B2 | 3/2009 | Field | |
| 8,096,846 | B2 | 1/2012 | Posner et al. | |
| 8,246,406 | B2 | 8/2012 | Field | |
| 8,393,928 | B2 | 3/2013 | Kumano et al. | |
| 8,408,958 | B2 | 4/2013 | Benham | |
| 8,465,334 | B2 | 6/2013 | Hort et al. | |
| 8,469,757 | B2 | 6/2013 | Luke et al. | |
| 2004/0248482 | A1 | 12/2004 | Larkin | |
| 2006/0019559 | A1* | 1/2006 | Mair | B63B 35/793 441/79 |
| 2007/0202760 | A1 | 8/2007 | Caldwell et al. | |
| 2010/0273373 | A1 | 10/2010 | Field | |
| 2011/0070787 | A1 | 3/2011 | Lausman | |
| 2012/0052755 | A1 | 3/2012 | Durante | |

FOREIGN PATENT DOCUMENTS

| | | | |
|---|---|---|---|
| WO | 2011/057330 | A1 | 5/2011 |

* cited by examiner

*Primary Examiner* — Daniel V Venne
(74) *Attorney, Agent, or Firm* — Kilpatrick Townsend & Stockton LLP

(57) ABSTRACT

A fin box that accepts fins from multiple different fin box systems. The fin box can include a fin box body and a detachable insert. The detachable insert can be inserted within and secured to the fin box body in multiple positions where each position enables one or more different types of fins to be used with the fin box.

20 Claims, 26 Drawing Sheets

FINBOX FOR MULTIPLE FIN SYSTEMS

CROSS-REFERENCES TO RELATED APPLICATIONS

This application claims the benefit of U.S. Provisional Application No. 62/188,298 filed Jul. 2, 2015 entitled "FINBOX FOR MULTIPLE FIN SYSTEMS" of which is incorporated by reference herein in its entirety for all purposes.

BACKGROUND OF THE INVENTION

Embodiments of the invention relate to fin boxes for watercraft, such as surfboards, paddle boards, boats and other aquatic devices. Some particular embodiments of the invention relate to fin boxes that can be used with more than one type of fin attachment mechanism.

Many surfboards, paddle boards, boats and other aquatic devices (referred to generically below as "watercraft") have one or more fins that improve directional stability and control of the watercraft. For example, some watercraft have a single fin at the rear of the watercraft that is sometimes referred to as a "center fin" or a "skeg". In addition to or instead of a center fin, some watercraft may have one or more pairs of fins mounted near the edge (or "rail") of the watercraft that are commonly referred to as "rail fins". Rail fins are typically positioned at an angle such that the leading edge of each rail fin is oriented toward the centerline of the watercraft.

One or more of the fins employed in some watercraft can be removable enabling the user of the watercraft to change the size and/or shape of the fins to change the way the watercraft moves through the water. For example, when surfing larger waves a particular surfer may want a relatively large fin while the same surfer may prefer a smaller fin when surfing smaller waves. Fins typically attach to a fin box that is embedded in the watercraft. For example, FIG. 1A is a simplified illustration depicting a bottom surface 104 of a surfboard 100 with removable fins, while FIGS. 1B and 1C are simplified side and rear plan views of surfboard 100. As shown in the figures, surfboard 100 includes a body 102 and three fins 110, 112 and 114. Fin 110 is a center fin while fins 112 and 114 are rail fins. Center fin 110 is attached to body 102 through a first fin box 120, while rail fins 112 and 114 are attached to body 102 through fin boxes 122 and 124, respectively.

A surfer may want to replace fin 110 with a different sized or shaped fin and can do so by removing the fin 110 from its respective fin box 120 and attaching a new fin to the fin box. Generally fin 110 has an attachment mechanism formed in a base of the fin that is specifically designed to enable the fin to be inserted into and secured to its respective fin box 120. Thus, fin 110 and fin box 120 are part of a fin box system and are specifically designed to be used together. Unfortunately, different manufacturers of fins may use different proprietary attachment systems. Thus, a first fin made by one manufacturer sometimes cannot be replaced on a particular surfboard with a second fin made by a different manufacturer as the attachment mechanism for the second fin may not be compatible with the fin box designed for use with the first fin. For example, two fin box systems commonly included in surfboards are made by FCS and Futures. Fins designed for the FCS fin box are not compatible with fins designed for the Futures fin box. Similarly, fins designed for the Futures fin box are not compatible with fins designed for the FCS fin box.

Some fin boxes have been developed that accept fins from different fin box systems, but each has limitations that make them less than ideal.

BRIEF SUMMARY OF THE INVENTION

Embodiments of the invention pertain to a fin box that accepts fins from multiple different fin box systems. In some embodiments, a fin box body is provided along with a detachable insert. The detachable insert can be inserted within and secured to the fin box body in multiple positions where each position enables one or more different types of fins to be used with the fin box. For example, as noted above, two fin box systems commonly used on surfboards available today are made by FCS and Futures. Some embodiments of the invention pertain to a fin box that includes a detachable insert that can be inserted within and secured to the fin box in either a first position in which fins made for the FCS fin box can be used on the surfboard or a second position in which fins made for the Futures fin box can be used on the surfboard. Other embodiments of the invention can be configured to work with additional fin box systems and/or different fin box systems. Fin boxes according to the invention can be used for center fins, for rail fins or for other types of fins.

According to some embodiments a fin box for a watercraft is provided that includes a body having an elongated cavity open at an exterior surface and a detachable insert configured to be inserted within the elongated cavity in either a first position or a second position different than the first position. When the detachable insert is inserted in the first position a fin having a fin base operable with a first fin system can be attached and secured to the fin box, and when the insert is inserted in the second position a fin having a fin base operable with a second fin system incompatible with the first fin system can be attached and secured to the fin box.

In some embodiments a fin box is provided that includes a detachable insert and a body having an elongated cavity open at an exterior surface, a flange having a generally planar surface surrounding the elongated cavity, and a raised lip extending between the flange and the elongated cavity. The detachable insert can have a length, a width and a height and include top and bottom opposing sides extending in the length and width directions and a sidewall extending between the top and bottom opposing sides. The sidewall can include at least first and second opposing surfaces extending in the length and height directions and third and fourth opposing surfaces extending in the width and height directions, where the top side includes first and second apertures formed in a top surface, the bottom side includes an elongated slot extending along a length of the bottom side, and one of the first or second opposing surfaces of the sidewall includes first and second channels that align with the first and second rails. The detachable insert can be sized and shaped so that it can be inserted within the elongated cavity in a first position in which a fin having a fin base operable with a first fin system can be attached and secured to the fin box, and a second position, different than the first position, in which a fin having a fin base operable with a second fin system incompatible with the first fin system can be attached and secured to the fin box. The detachable insert and elongated cavity can have complementary shapes so that the insert can fit within the cavity. In some instances the insert and cavity can each have an hour glass shape and in other instances the insert and cavity can each have substantially rectangular shapes.

According to some embodiments a fin box for a watercraft is provided that includes a body and a detachable insert. The body includes a generally planar exterior surface and a recess formed in the body. The recess has an insert receiving portion and a fin receiving portion adjacent to the insert receiving portion. The detachable insert can be inserted within the insert receiving portion in first or second positions to define the size and shape of the fin receiving portion. When the insert is in the first position a fin having a fin base operable with a first fin system can be inserted into the fin receiving portion of the recess and secured within the fin box and when the insert is in the second position a fin having a fin base operable with a second fin system incompatible with the first fin system can be inserted into the fin receiving portion of the recess and secured within the fin box.

The foregoing, together with other features and embodiments will become more apparent when referring to the following specification, claims, and accompanying drawings.

DETAILED DESCRIPTION OF THE INVENTION

Figure 1A:
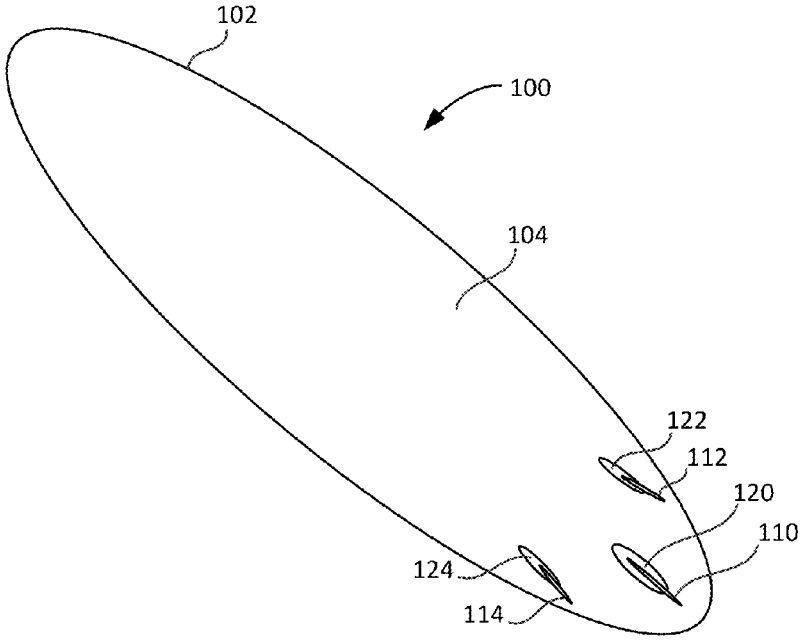
FIGS. 1A-1C are simplified illustrations depicting various views of a surfboard with removable fins.
Figure 1B:
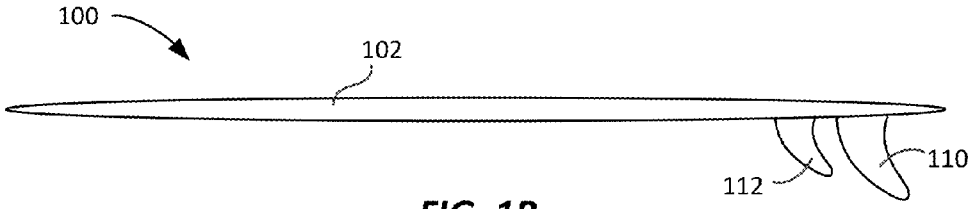
Figure 1C:
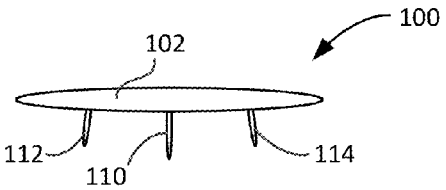
Figure 2A:
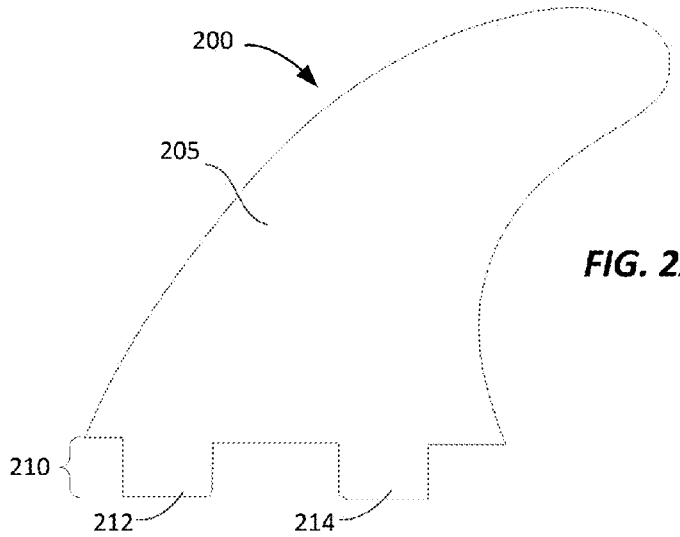
FIG. 2A is an illustration of a first fin that uses a first attachment mechanism.

Embodiments of the invention pertain to a fin box for a watercraft, such as a surfboard, a paddle board or the like, that accepts fins from multiple different fin box systems. For example, FIG. 2A is a simplified side plan view of a first type of fin 200 that includes a blade 205 and a fin base 210 having first and second tabs 212 and 214, respectively. Fin 200 is configured to work with a fin box 250 shown in FIG. 2B. Fin box 250 includes first and second apertures 262 and 264 along with an upper, substantially flat surface 265 that, when fin box 250 is attached to a surfboard or other watercraft, lies in a plane parallel with an exterior surface of the surfboard. Fin 200 can be inserted in fin box 250 by aligning tabs 212 and 214 with apertures 262 and 264, respectively, and sliding the fin into the fin box. Once inserted, fin 200 can then be secured to the fin box with grub screws (not shown) that extend through angled screw holes 272 and 274 and, when tightened, contact tabs 212 and 214, respectively.

Figure 3A:
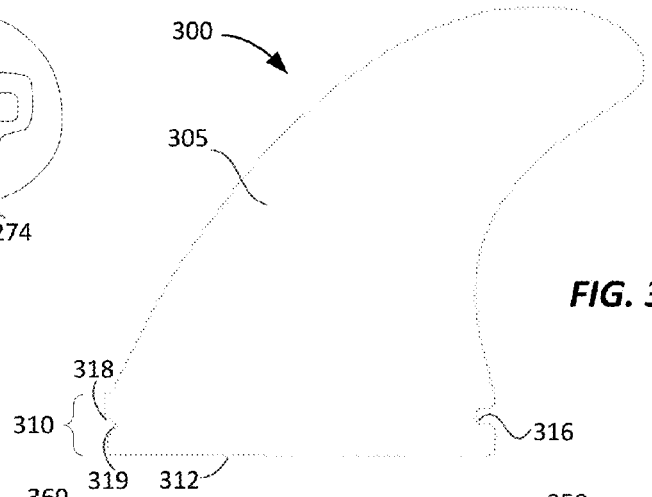
FIG. 3A is an illustration of a second fin that uses a second attachment mechanism different from the attachment mechanism used by the first fin shown in FIG. 2A.

FIG. 3A is a simplified side plan view of a second type of fin 300 that includes a blade 305 having a fin base 310 that includes a bottom surface 312 and, optionally, may include multiple windows (not shown) spaced along the fin base. Fin base 310 also includes a first retaining notch 316 along with a second retaining notch 318. Fin 300 is configured to work with a fin box 350 shown in FIG. 3B. Fin box 350 includes an elongated open slot 362 framed by a sidewall that extends around the interior perimeter of slot 362 and a bottom surface 364. Similar to fin box 250, fin box 350 includes an upper, substantially flat surface 365 that, when the fin box 350 is attached to a surfboard or other watercraft, lies in a plane parallel with an exterior surface of the surfboard.

Within elongated slot 362 is an optional pin 366 positioned at one end of slot 362 and extending across its width. Pin 366 is positioned between bottom surface 364 and upper surface 365 leaving space within the elongated slot both above and below the pin. Fin 300 can then be inserted into elongated slot 362 at a slight angle so that retaining notch 316 aligns with pin 366 with the pin fitting within the retaining notch. Once inserted, fin 300 can be fully lower into elongated slot 362 so that bottom surface 312 of fin base 310 is in contact with and parallel to bottom surface 364. Fin 300 can then be secured to the fin box with a grub screw (not shown) that extends through an angled screw hole 368 and, when tightened, is positioned within retaining notch 318 and abuts a seating surface 319 normal to the axis of angled screw hole 368.

Figure 2B:
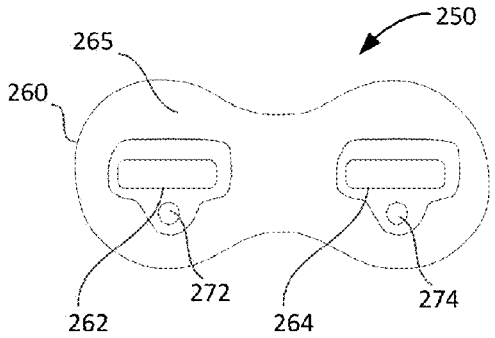
FIG. 2B is an illustration of a first fin box that is compatible with the fin shown in FIG. 2A.
Figure 3B:
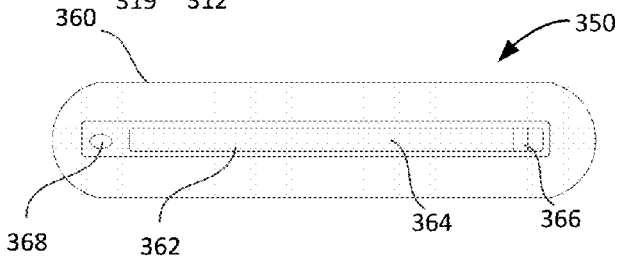
FIG. 3B is an illustration of a second fin box that is compatible with second fin shown in FIG. 3A.

As evident from a comparison of the fin box system of FIGS. 2A and 2B to the fin box system of FIGS. 3A and 3B, fin 200 is not designed to work with, and is actually incompatible with, fin box 350. For example, while tabs 212 and 214 of fin 200 may fit within elongated slot 362 of fin box 350, the attachment mechanism (pin 366 and the grub screw threadably coupled to angled screw hole 368) will not operate properly to secure fin 200 to fin box 350. Similarly fin 300 is not designed to work with, and is actually incompatible with fin box 250 as fin base 310 will not fit within notches 262 and 264 of fin box 250. Some embodiments of the invention solve this problem by providing a fin box that is configured to accept both fin 200 and fin 300 as described in detail below.

In some embodiments of the invention, a fin box is provided that includes a fin box body along with a detachable insert. The detachable insert can be inserted within and secured to the fin box body in multiple positions where each position enables one or more different types of fins to be used with the fin box. For example, as noted above, two fin box systems commonly used on surfboards available today are made by FCS and Futures. Fin 200 is representative of a fin intended to be used in an FCS fin box system, while fin 300 is representative of a fin intended to be used in a Futures fin box system. Some embodiments of the invention pertain to a fin box that includes a detachable insert that can be inserted within and secured to the fin box in either a first position in which fins made for the FCS fin box can be used on the surfboard (e.g., fin 200) or a second position in which fins made for the Futures fin box can be used on the surfboard (e.g., fin 300). In both configurations the detachable insert is positioned within and secured to the fin box, which ensures that the insert is less likely to be misplaced or lost as compared to if the insert was only used in one or a subset of the configurations. Other embodiments of the invention can be configured to work with more than two fin systems, for example, by providing a configuration in which a detachable insert can be attached to the fin box in more than two positions. Similarly, other embodiments of the invention can be configured to work with fin systems different than the FCS and Future fin systems described above.

Figure 4:
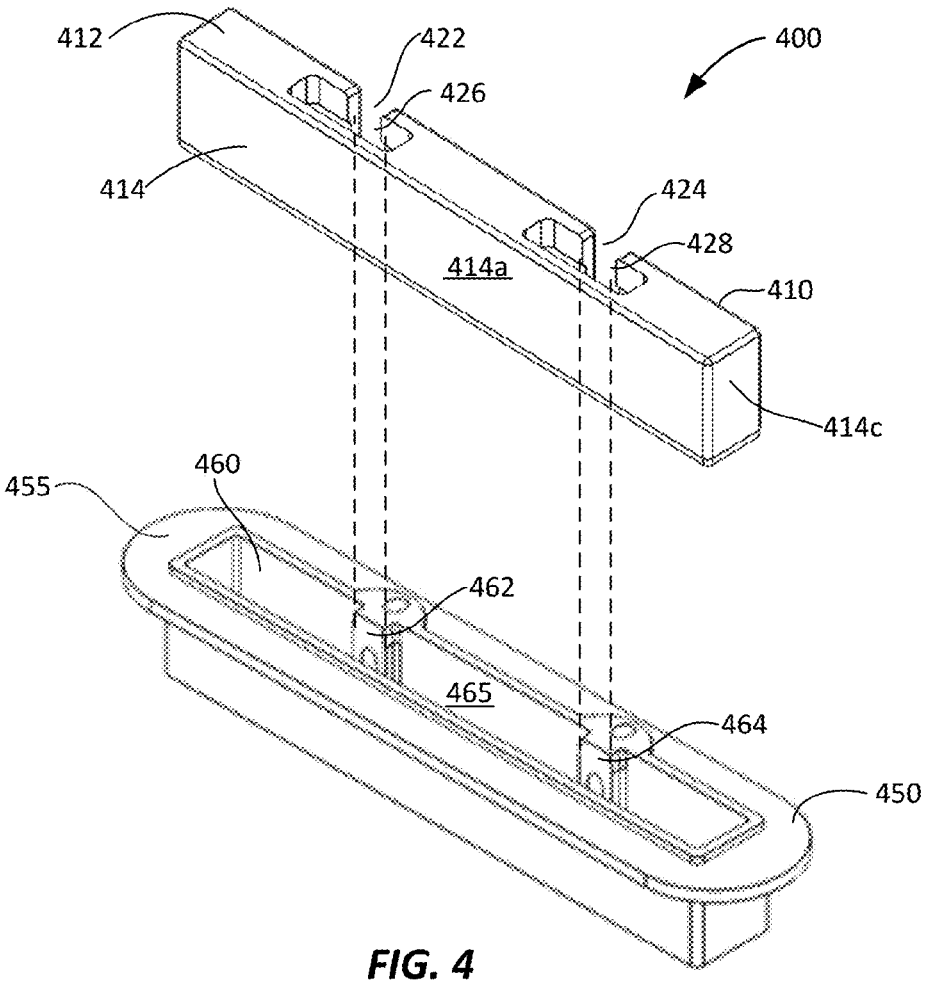
FIG. 4 is a simplified exploded perspective view of a fin box according to an embodiment of the invention with the detachable insert ready to be secured to the fin box in a first position compatible with the fin shown in FIG. 2A.

To better appreciate and understand certain embodiments of the invention, reference is now made to FIGS. 4-7. FIG. 4 is a simplified exploded perspective view of a fin box 400 according to an embodiment of the invention that includes a detachable insert 410 and a fin box body 450, each of which can be manufactured or made from a variety of suitable materials, such as a molded plastic or printed on a three-dimensional printer. Detachable insert 410 can be attached to fin box body 450 in either a first or a second position. In the first position, fin box 400 is compatible with fins intended for an FCS fin box, such as fin 200. In the second position, fin box 400 is compatible with fins intended for a Futures fin box, such as fin 300. As shown in FIG. 4, detachable insert 410 is ready to be secured to a fin box body 450 in the first position that is compatible with fin 200 shown in FIG. 2A.

Detachable insert 410 is generally rectangular in shape (e.g., a rectangular prism that has a length, width and height) and includes a first surface 412 extending along the length and width of insert 410 and a side surface 414. Opposite first surface 412 is an elongated slot 440 (shown in FIG. 6) with an opening defined by a perimeter 416 of side surface 414. For convenience, first surface 412 is sometimes referred to herein as an "upper surface" while elongated slot 440 is sometimes referred to as being open on the "bottom side" of insert 410. This nomenclature is for ease of explanation only as which side is physically up and which side is physically down depends on which position (e.g., the first position or the second position) that insert 410 is attached to fin box body 450 in as well as whether the surfboard or watercraft the fin box body 450 is formed in is positioned with its fin or fins up or down. Also, if the surfboard or watercraft is positioned on its side with one of its rails facing up, neither first surface 412 or elongated slot 440 is technically facing up or down. Similar use of the terms "upper" and "bottom" apply to the description of certain features of fin box body 450 described below as, once the fin box is installed in a surfboard or watercraft, whether or not a particular feature of the fin box is physically above another will depend on the orientation of surfboard or watercraft—i.e., whether such is in a fin-up position or a fin-down position.

Referring back to FIG. 4, detachable insert 410 also includes first and second channels 422 and 424 that extend from the bottom side of the insert to upper surface 412 and apertures 426 and 428 formed in surface 412 adjacent to channels 422, 424, respectively. Side surface 414 includes four separate surfaces including: first and second opposing surfaces 414*a* (shown in both FIGS. 4 and 6) and 414*b* (in which channels 422 and 424 are formed) that extend along the length and height of insert 410, and third and fourth opposing surfaces 414*c* (shown in FIG. 4) and 414*d* (shown in of FIG. 6) that extend along the width and height of insert 410. The side surfaces form an outer perimeter of insert 410 and each side surface includes an opposing inner surface that combines with the other inner surfaces to define elongated slot 440. Thus, in the embodiment shown in FIGS. 4-7, detachable insert 410 is essentially hollow, open at the bottom side and closed on all other sides except for the channels and apertures discussed below.

Fin box body 450 includes a central elongated cavity 460. Elongated cavity 460 is open at an upper, exterior surface of fin box body 450 and is sized and shaped to accept detachable insert 410 such that when the insert is placed within the cavity it cannot be moved in a lateral direction—either forward and back or left and right—more than a de minimis amount. Within elongated cavity 460 are first and second rails 462 and 464 that extend along an inner sidewall perpendicular to the opening of cavity 460. Rails 462 and 464 align with channels 422 and 424 so that the channels can slide over the rails when insert 410 is inserted into fin box body 450 as indicated by the dotted lines in FIG. 4. Specifically, when detachable insert 410 is pushed into fin box body 450 in the first position, channel 422 slides over rail 462 and channel 424 slides over rail 464. These channel/rail pairings are switched in the second position as described below with respect to FIG. 6.

Figure 5:
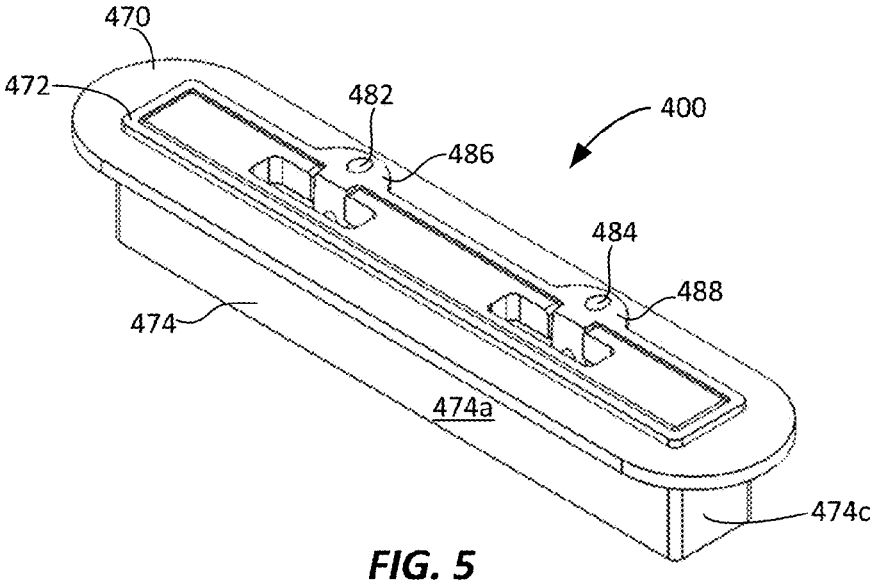
FIG. 5 is a simplified perspective view of the fin box shown in FIG. 4 with the detachable insert secured to the fin box in the first position.

FIG. 5 is a simplified perspective view of detachable insert 410 insert fitted within elongated cavity 460 in the first position shown in FIG. 4. Apertures 426 and 428 are sized and shaped similar to, and spaced apart the same distance as, apertures 272 and 274. Thus, when the detachable insert is inserted within cavity 460, fin 200 can be readily mounted and secured to fin box body 450 in essentially the same manner that fin 200 can be mounted to fin box 250. That is, fin 200 can be inserted in fin box body 450 by aligning tabs 212 and 214 with apertures 426 and 428, respectively, and pushing the fin down into the fin box. Once inserted, fin 200 can then be secured to fin box body 450 with grub screws (not shown) that extend through angled screw holes 482 and 484 and, when tightened, contact and exert a force against tabs 212 and 214, respectively, securing fin 200 to the fin box.

Figure 6:
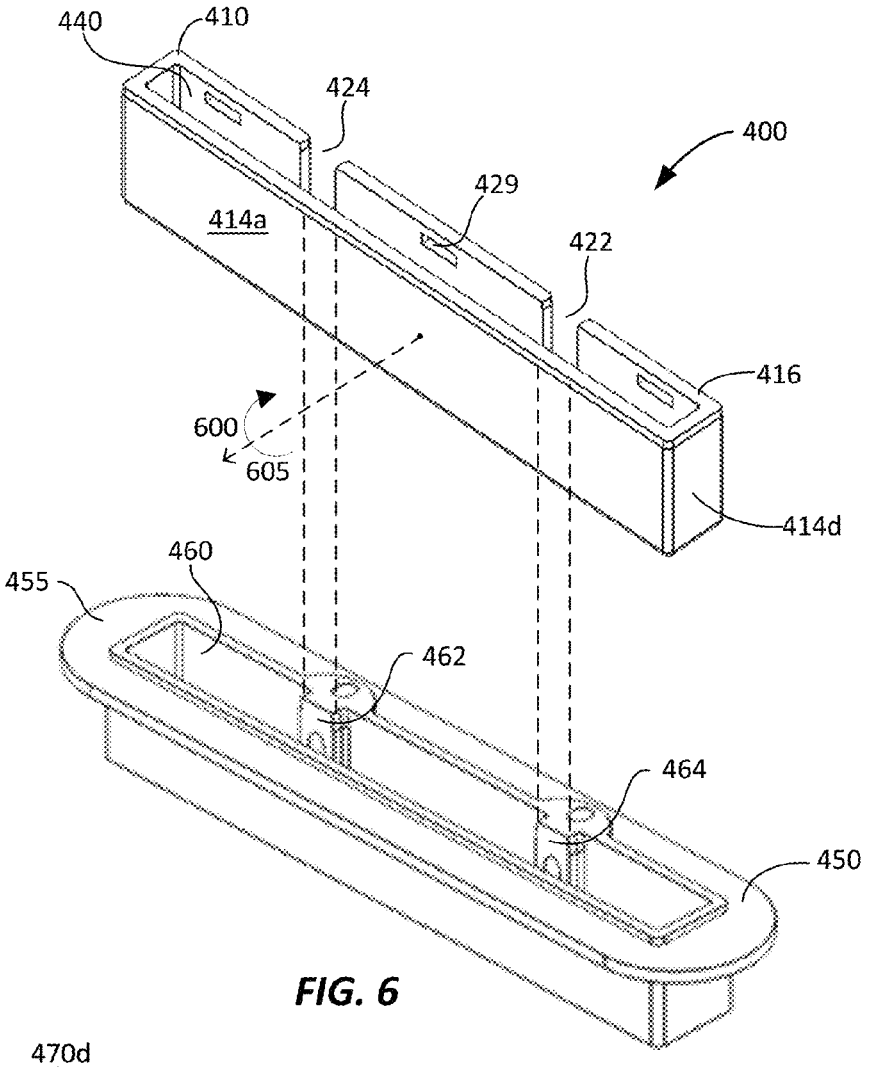
FIG. 6 is a simplified exploded perspective view of a fin box according to an embodiment of the invention with the detachable insert ready to be secured to the fin box in a second position compatible with the fin shown in FIG. 3A.

Detachable insert 410 can also be inserted and secured to fin box body 450 in a second position that is compatible with fin 300 shown in FIG. 3A. FIG. 6 is a simplified exploded perspective view of the same fin box 400 shown in FIG. 4 with detachable insert 410 ready to be secured to fin box body 450 in the second position instead of the first position. In the second position, detachable insert 410 is flipped upside down relative to its position in FIG. 4. That is, insert 410 is rotated 180 degrees around an axis 600 as shown by arrow 605 so that channels 422 and 424 still align with rails 462 and 464 but with channel 422 fitting over rail 464 and channel 424 fitting over rail 462.

Figure 7:
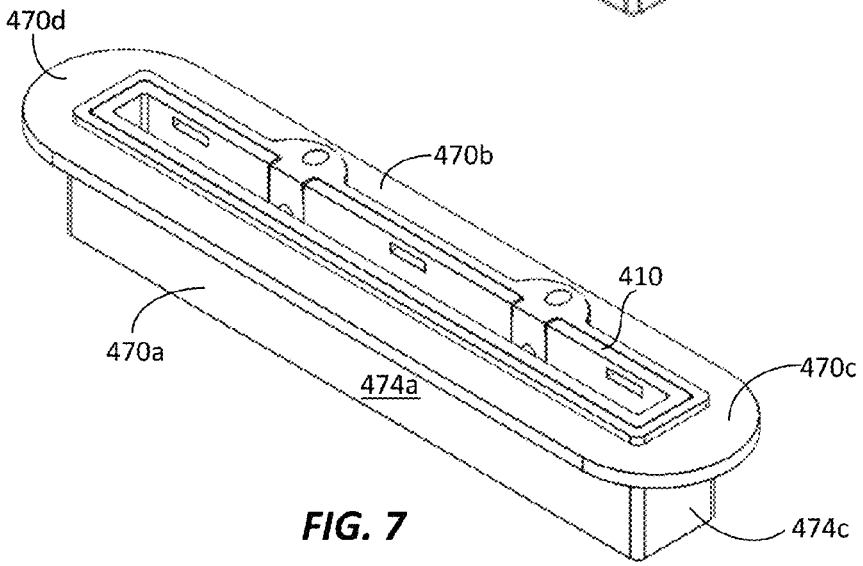
FIG. 7 is a simplified perspective view of the fin box shown in FIG. 4 with the detachable insert secured to the fin box in the second position.

Detachable insert 410 includes an open elongated slot 440 that is surrounded by and defined by the interior surfaces of sidewall 414 (sidewalls 414*a*, 414*b*, 414*c* and 414*d*). Elongated slot 440 is side sized and shaped to accept fin blade 310 of fin 300. When the insert is pushed into elongated cavity 460, elongated slot 440 is exposed at an upper, exterior surface of fin box body 450 as shown in FIG. 7, which is a simplified perspective view of detachable insert 410 insert fitted within elongated cavity 460 in the second position shown in FIG. 6. Elongated slot 440 is sized and shaped similar to elongated slot 362 in FIG. 3B. Thus, when the detachable insert is inserted within cavity 460 in the second position, fin base 310 of fin 300 fits within elongated slot 362. Grub screws (now shown) can then be tightened in each of the angled screw holes 482 and 484 to exert a force against fin base 310 securing fin 200 to the fin box. The detachable insert also includes multiple openings 429 that can be used to facilitate removal of the insert from elongated slot 440, for example, with a thin screw driver or other tool.

As shown in each of FIGS. 4-7, fin box body 450 includes a flange 470 that surrounds elongated cavity 460 and a raised lip 472 that extends between flange 470 and cavity 460. Elongated cavity 460 has a depth that is substantially equal to a height of insert 410. Thus, when detachable insert 410 is positioned within the slot, either upper surface 412 of the insert or lower surface 416 of the insert, depending on whether the insert is in the first or second position, rests on a bottom surface 466 (shown in FIGS. 9B and 9D) of cavity 460 while the other of upper surface 412 or lower surface 416 is substantially aligned with lip 472. Fin box body 450 also includes a generally rectangular shaped lower portion 474 that includes first and second opposing side surfaces 474*a* and 474*b* (of which only 474*a* is shown in FIGS. 4-7) that extend along a length of lower portion 474 and third and fourth opposing side surfaces 474*c* and 474*d* (of which only surface 474*c* is shown in FIGS. 4-7) that extend along a width of the lower portion. Flange 470 is substantially flat and includes two generally straight, opposing sides 470*a* and 470*b* along with two semicircular, opposing ends 470*c* and 470*d*. Flange side 470 extends beyond lower portion 474 on all sides such that flange side 470*a* extends beyond side surfaces 474*a*, flange side 470*b* extends beyond side surface 474*b*, flange end 470*c* extends beyond side surface 474*c*, and flange end 470*d* extends beyond side surface 474*d*.

Fin box body 450 can be incorporated into a surfboard or other watercraft using a variety of different techniques. As one example, where the surfboard includes a foam core, an elongated trench can be cut (e.g., with a router) in the core that is sized and shaped to accept lower portion 474 and a second wider but much shallower trench can be cut that is sized and shaped to accept flange 470. Resin can be applied over the trenches to protect the core from water and fin box body 450 can be positioned within the trenches by a press-fit. Sealing tap can then be placed around the fin box and flange 470 can then be covered with fiberglass, epoxy or other appropriate material leaving lip 472 and elongated cavity 460 uncovered. To provide a more secure fit between fin box body 450 and the surfboard or water craft into which it is formed, lower portion 474 of the fin box body may have one or more relatively narrow fins (e.g., fins 1508 shown in FIG. 15C) that extend outward from lower portion 474. The fins can extend outward in a perpendicular direction or at different angles to the lower portion. The primary elongated trench can be cut in the foam core of the surfboard to the size and shape of lower portion 474 such that when fin box body 450 is pressed into the trench, the fins cut through the foam core acting as anchors that reduce rotation or other movement of the fin box within the surfboard.

Figure 8A:
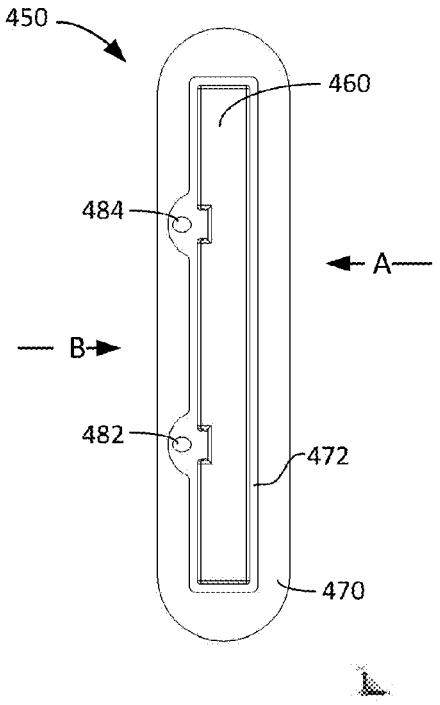
FIGS. 8A and 8B are top and bottom plan views, respectively, of the fin box shown in FIGS. 4-7 without its detachable insert.
Figure 8B:
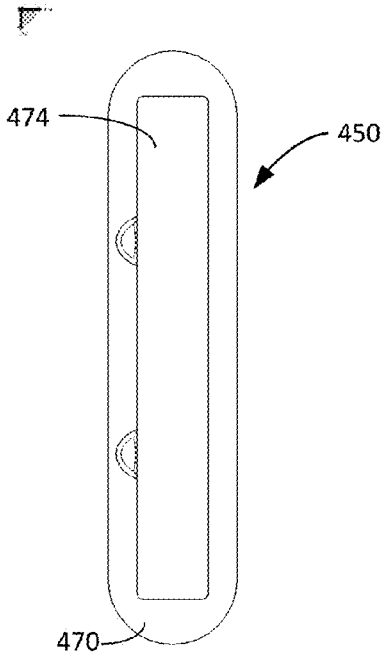
Figure 8C:
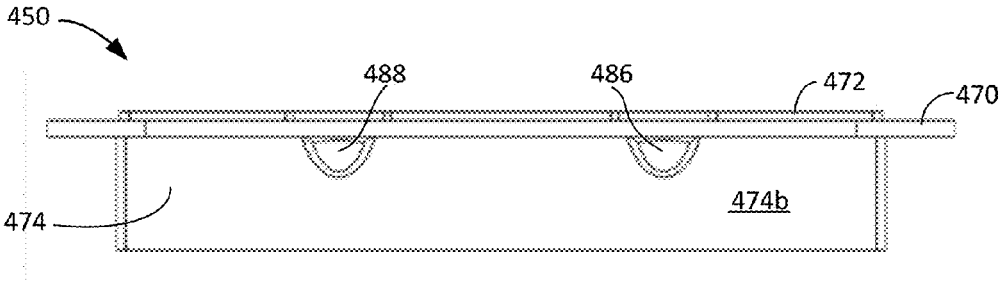
FIGS. 8C and 8D are left and right side plan views of the fin box shown in FIGS. 8A and 8B.
Figure 8D:
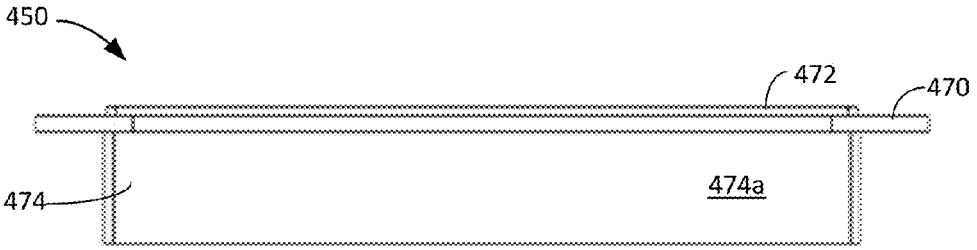
Figure 8E:
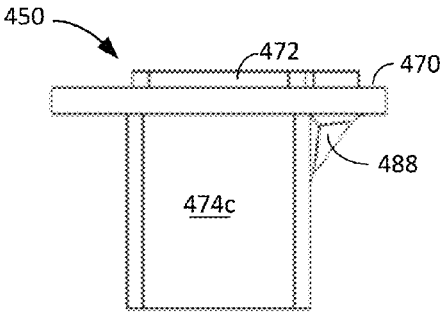
FIGS. 8E and 8F are front and rear plan views of the fin box shown in FIGS. 8A and 8B.
Figure 8F:
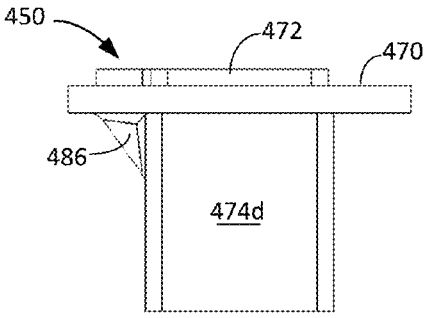

FIGS. 8A through 12C are various plan views of the fin box 400 described above with respect to FIGS. 4-7 showing additional views and angles of various components of the fin box to provide further detail than FIGS. 4-7. Specifically, FIGS. 8A and 8B are top and bottom plan views, respectively, of fin box body 450 without detachable insert 410 inserted therein. As shown in FIG. 8A, flange 470 and lip 472 each surround central elongated cavity 460. As shown in FIG. 8B, flange 470 also surrounds lower portion 474. FIGS. 8C and 8D are left and right side plan views of fin box body 450 shown in FIGS. 8A and 8B, and FIGS. 8E and 8F are front and rear plan views of the fin box body 450 shown in FIGS. 8A and 8B. Each of these figures further shows flange 470 extending outward past the edges of lower portion 474 along with lip 472 extending slightly above the flange. FIG. 8C further shows that lower portion 474 includes first and second extensions 486 and 488 that accommodate angled screw holes 482 and 484, respectively.

Figure 9A:
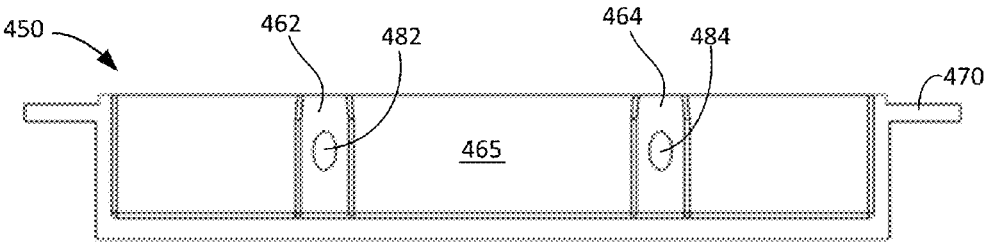
FIG. 9A is a cut-away side plan view of the fin box shown in FIG. 8A looking in direction A.
Figure 9B:
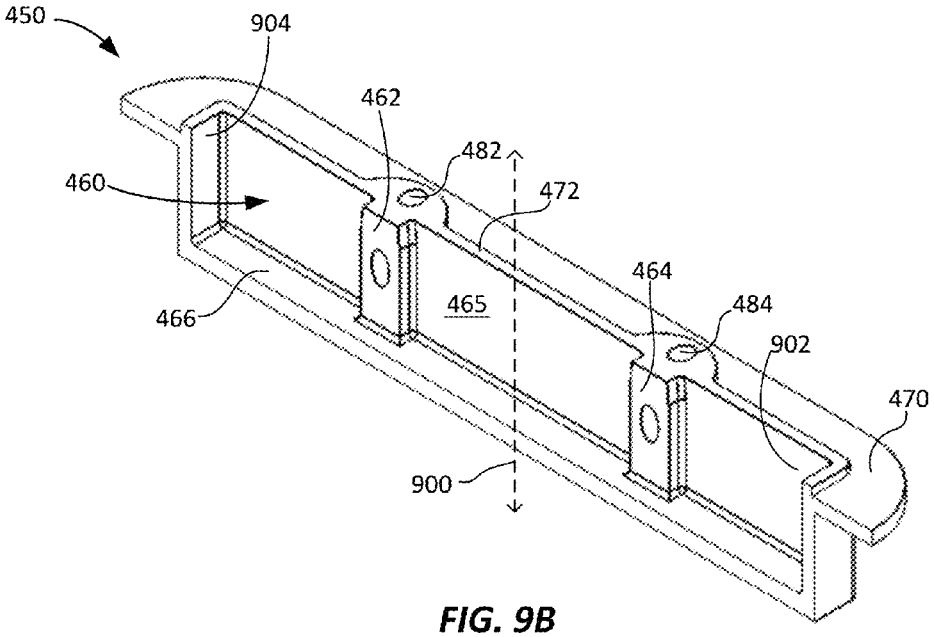
FIG. 9B is a cut-away side perspective views of the fin box shown in FIG. 8A looking in direction A.

FIG. 9A is a cut-away side plan view of the fin box shown in FIG. 8A looking in direction A, while FIG. 9B is a cut-away side perspective view of the fin box shown in FIG. 8A looking in direction A. As shown in FIGS. 9A and 9B, each of rails 462 and 464 is positioned between a centerline 900 that bisects the length of cavity 460 and first and second ends 902 and 904 of the cavity. In other embodiments of the invention, fewer or more than two rails may be provided in which case an equal number of channels in the detachable insert can also be provided. Also, embodiments of the invention are not limited to any particular location of the rails and corresponding channels and may include rails on or closer to centerline 900 as well as rails closer to ends 902 and 904.

Figure 9C:
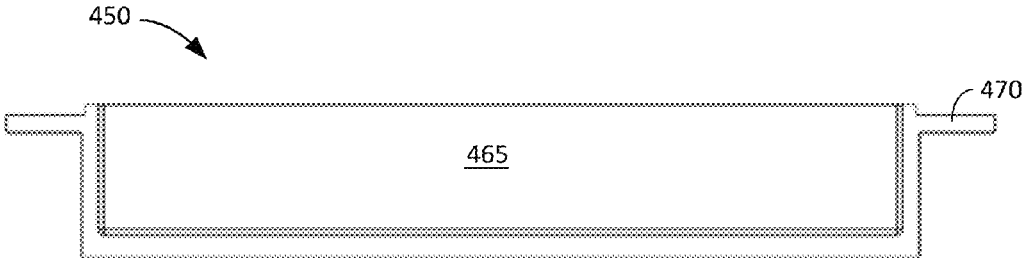
FIG. 9C is a cut-away side plan view of the fin box shown in FIG. 8A looking in direction B.
Figure 9D:
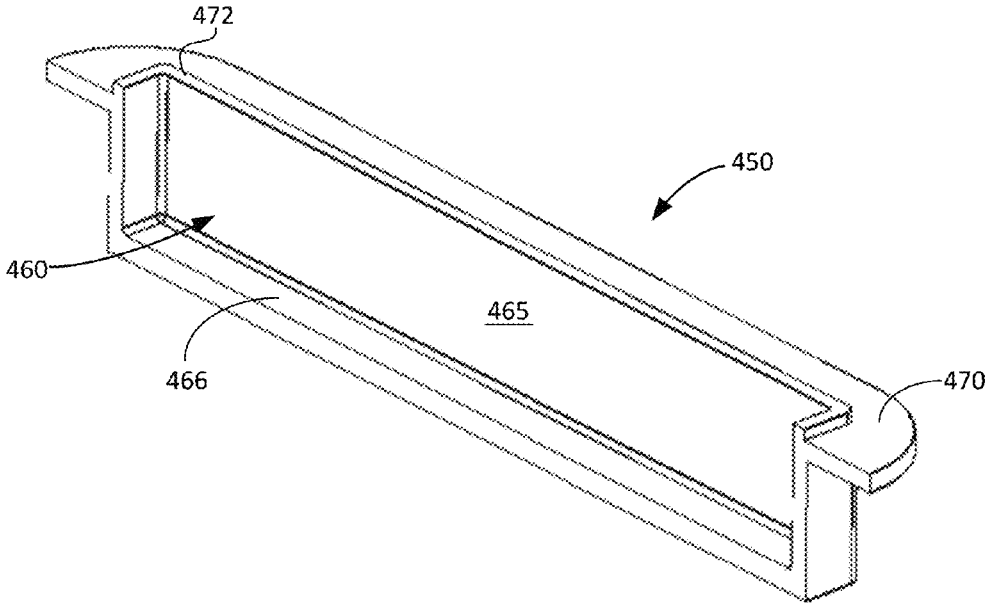
FIG. 9D is a cut-away side perspective views of the fin box shown in FIG. 8A looking in direction B.

FIG. 9C is a cut-away side plan view of the fin box shown in FIG. 8A looking in direction B, while FIG. 9D is a cut-away side perspective views of the fin box shown in FIG. 8A looking in direction B. As shown in FIGS. 9C and 9D, the interior surface 465 of cavity 460 on this side can be a substantially flat surface that minimizes the accumulation of sand, dirt or other material within the cavity.

Figure 10A:
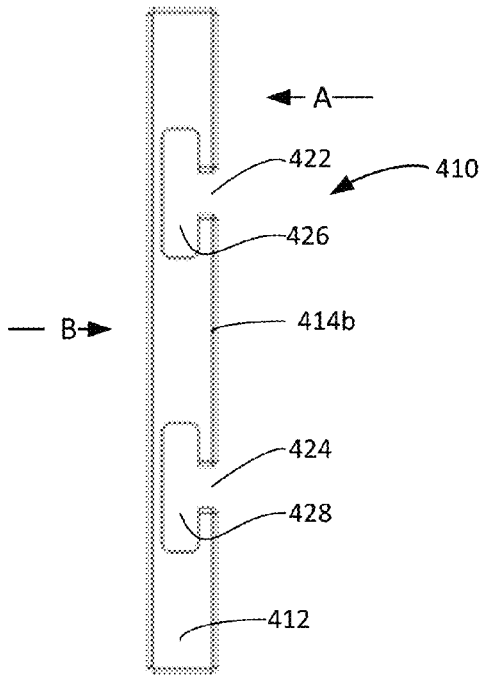
FIGS. 10A and 10B are top and bottom plan views, respectively, of the detachable insert shown in FIGS. 4-7.
Figure 10B:
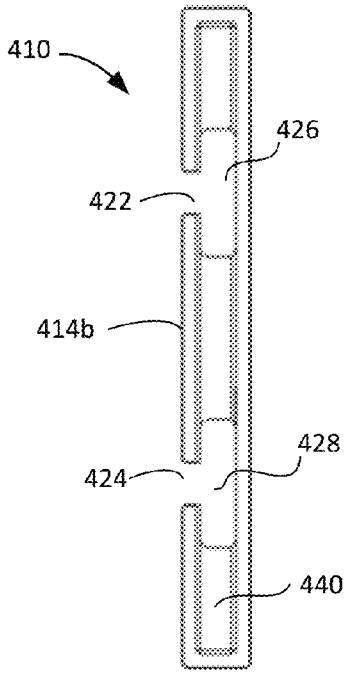
Figure 10C:
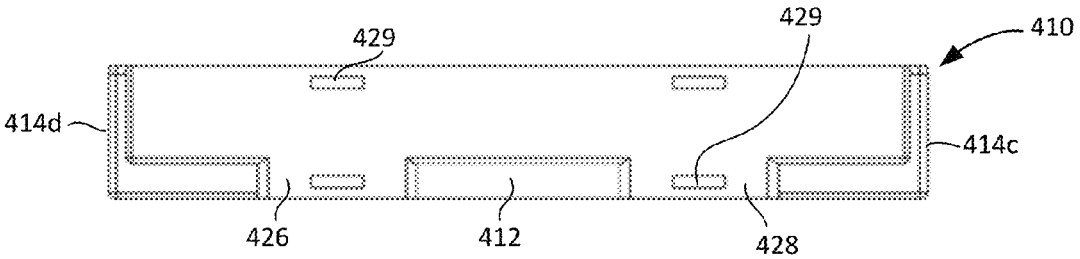
FIG. 10C is a cut-away side plan view of the detachable insert shown in FIG. 10A looking in direction A.
Figure 10D:
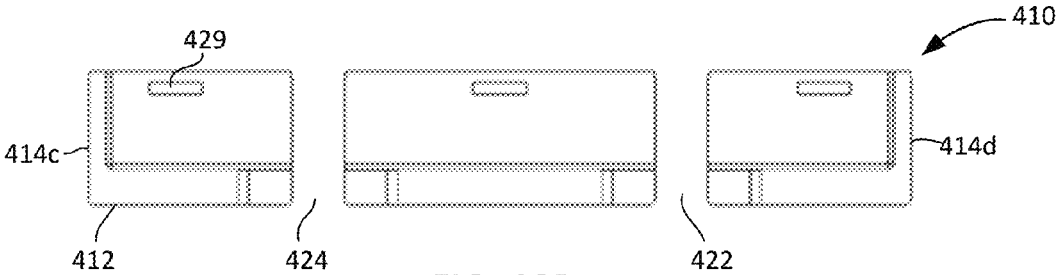
FIG. 10D is a cut-away side plan view of the detachable insert shown in FIG. 10A looking in direction B.

FIGS. 10A and 10B are top and bottom plan views, respectively, of detachable insert 410 shown in FIGS. 4-7 further showing channels 422 and 424 formed in side surface 414*b* along with apertures 426 and 428 formed in upper surface 412. As previously mentioned, apertures 426 and 428 are sized and shaped to accommodate tabs 212 and 214 of fin 200. In other embodiments, where a fin box according to the invention is compatible with a different fin type having tabs of a different size or spacing than tabs 212 and 214, apertures 426 and 428 can be sized and spaced as appropriate for the other fin type. Similarly, if a particular fin type has fewer or more than two tabs, insert 410 may include an appropriate number of apertures formed in surface 412 or may include another type of alignment mechanism altogether. FIG. 10C is a cut-away side plan view of detachable insert 410 shown in FIG. 10A looking in direction A, while FIG. 10D is a cut-away side plan view of detachable insert 410 looking in direction B. As shown in each of FIGS. 10C and 10D, insert 410 can include one or more holes 429 that can be used to facilitate removal of insert 410 from finbox 450 as described above.

Figure 11A:
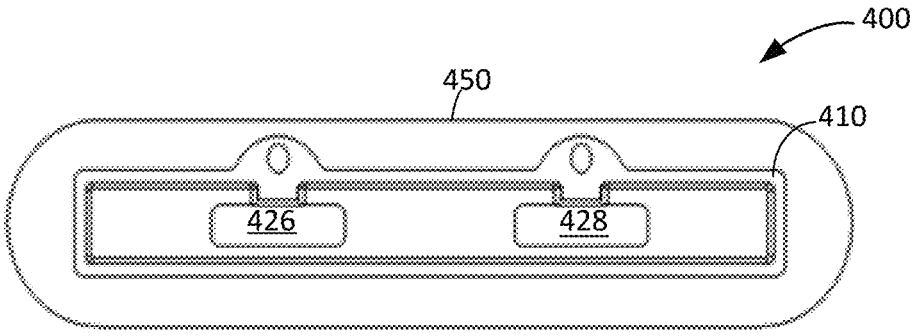
FIG. 11A is a top plan view of the fin box shown in FIGS. 8A-8H with the detachable insert shown in FIGS. 10A-10D inserted in FCS mode according to an embodiment of the invention.
Figure 11B:
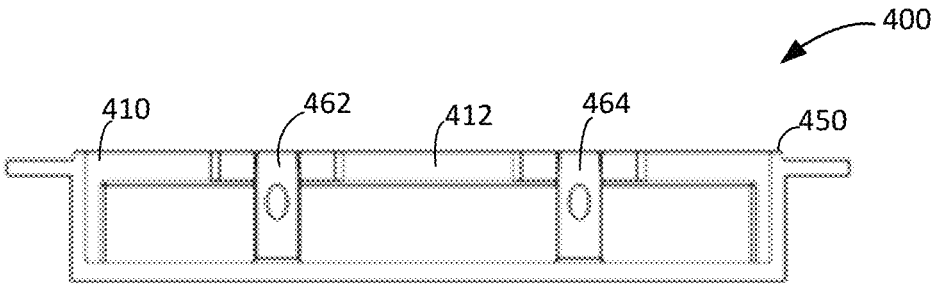
FIG. 11B is a cut-away side plan view of the fin box and detachable insert shown in FIG. 11A looking in direction A.
Figure 11C:
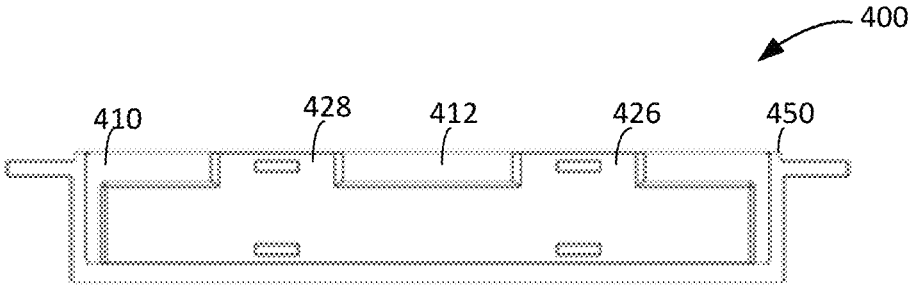
FIG. 11C is a cut-away side plan view of the fin box and detachable insert shown in FIG. 11A looking in direction B.

FIG. 11A is a top plan view of fin box 400 including fin box body 450 shown in FIGS. 8A-8H with detachable insert 410 shown in FIGS. 10A-10D inserted in the first position (FCS mode) according to an embodiment of the invention. FIG. 11B is a cut-away side plan view of the fin box and detachable insert shown in FIG. 11A looking in direction A, and FIG. 11C is a cut-away side plan view of the fin box and detachable insert shown in FIG. 11A looking in direction B.

Figure 12A:
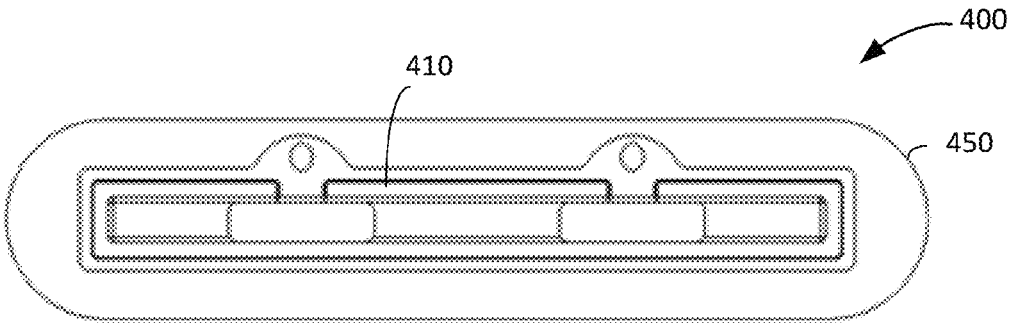
FIG. 12A is a top plan view of the fin box shown in FIGS. 8A-8H with the detachable insert shown in FIGS. 10A-10D inserted in Futures mode according to an embodiment of the invention.
Figure 12B:
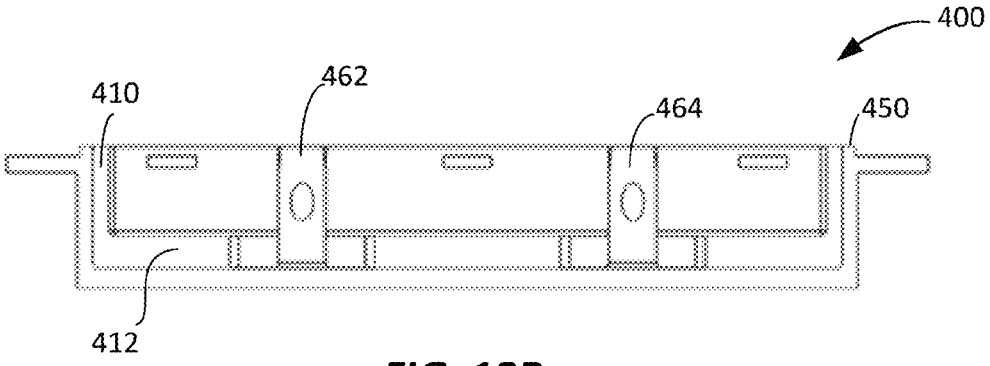
FIG. 12B is a cut-away side plan view of the fin box and detachable insert shown in FIG. 12A looking in direction A.
Figure 12C:
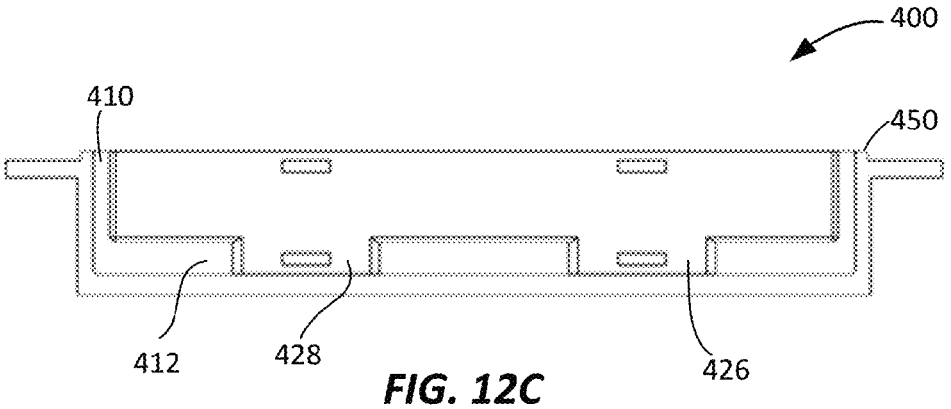
FIG. 12C is a cut-away side plan view of the fin box and detachable insert shown in FIG. 12A looking in direction B.

FIG. 12A is a top plan view of fin box 400 including fin box body 450 shown in FIGS. 8A-8H with detachable insert 410 shown in FIGS. 10A-10D inserted in the second position (Futures mode) according to an embodiment of the invention. FIG. 12B is a cut-away side plan view of the fin box and detachable insert shown in FIG. 12A looking in direction A, and FIG. 12C is a cut-away side plan view of the fin box and detachable insert shown in FIG. 12A looking in direction B.

Figure 13A:
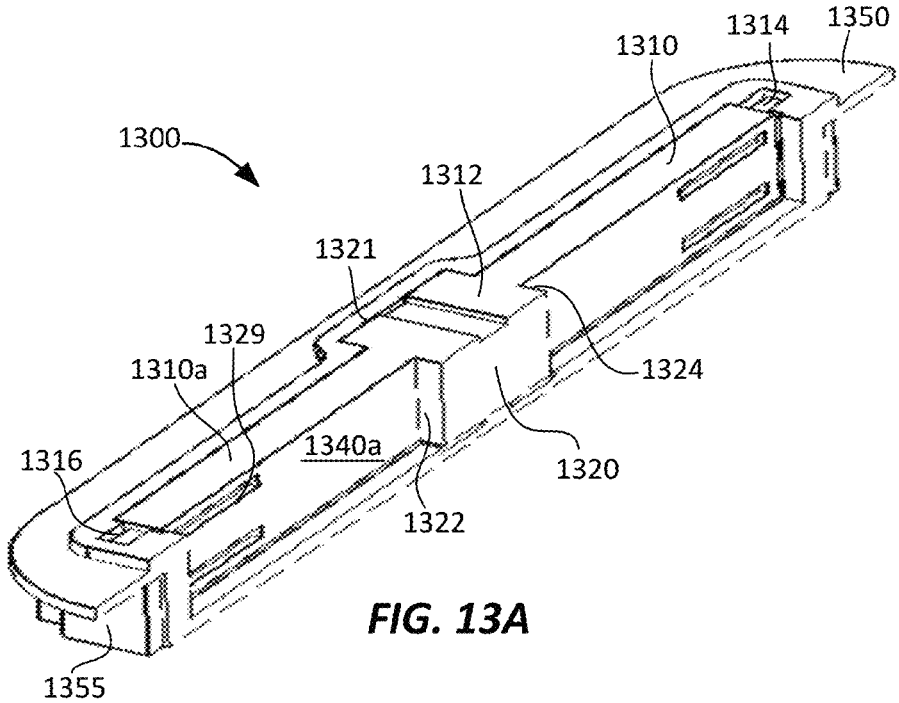
FIG. 13A is a cut-away side perspective views of the fin box according to another embodiment of the invention with a detachable insert set in a fin box body in a first position.
Figure 13B:
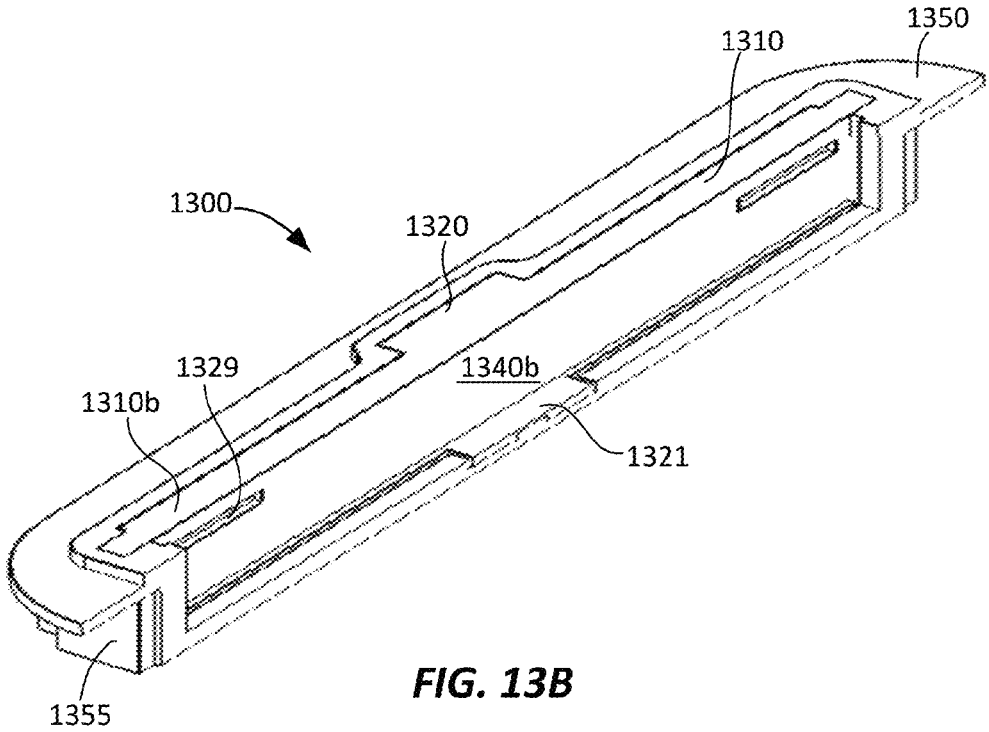
FIG. 13B is a cut-away side perspective views of the fin box shown in FIG. 13A with the detachable insert set in the fin box body in a second position.

FIGS. 13A and 13B are cut-away side perspective views of a fin box 1300 according to another embodiment of the invention that includes a detachable insert 1310 and a fin box body 1350. Similar to fin box 400, detachable insert 1310 can be inserted secured to fin box body 1350 in either a first position (FIG. 13A) in which fins made for the FCS fin box can be used with the fin box (e.g., fin 200) or a second position (FIG. 13B) in which fins made for the Futures fin box can be used with the fin box (e.g., fin 300). In both configurations detachable insert 1310 is inserted within a portion of a recess 1360 formed in body 1350 as described more fully below.

As shown in FIGS. 13A and 13B, detachable insert 1310 has a central member 1312 along with first and second alignment features 1314 and 1316 at opposing ends of insert 1310. Central member 1312 has first and second opposing features 1320 and 1321 that extend perpendicular to the length of insert 1310 on each side of the insert. As shown in FIG. 13A, feature 1320 can extend from an upper surface 1310*a* of insert 1310 to a lower surface 1310*b* of insert 1310 and includes first and second seats 1322 and 1324 on opposing side surfaces of the feature 1320. As shown in FIG. 13B, feature 1321 can be a relatively thin shelf that extends out from surface 1310*a*. Detachable insert 1310 can also include multiple slots 1329 that can facilitate removal of insert 1310 from fin box body 1350.

Figure 14A:
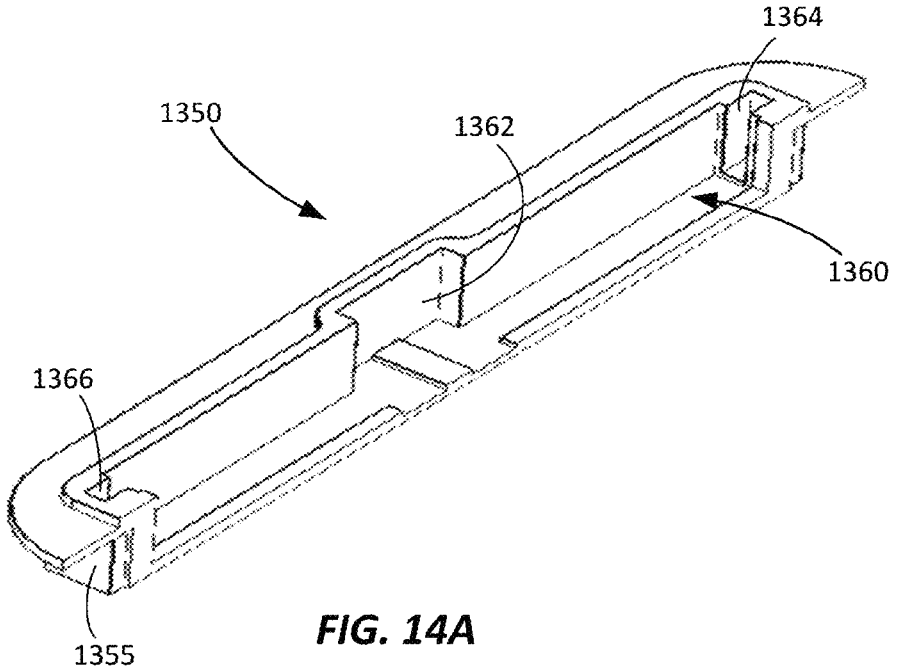
FIG. 14A is a cut-away side perspective views of the fin box shown in FIG. 13A looking in a first direction.
Figure 14B:
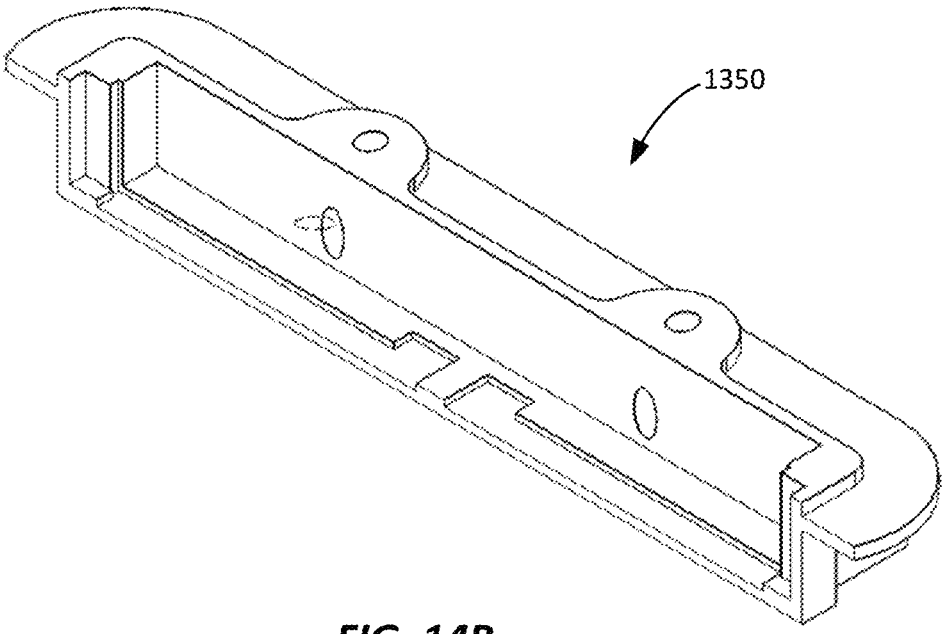
FIG. 14B is a cut-away side perspective views of the fin box shown in FIG. 13A looking in a second direction.

Referring to FIG. 14A, fin box body 1350 includes a recess 1360 that is open at an upper, exterior surface of fin box body 1350. Recess 1360 is sized and shaped to accept detachable insert 1310 within a portion of the recess such that when the insert is placed within the recess, the detachable insert defines an area of the recess into which a fin base can be received. Thus, recess 1360 can be said to have a first insert receiving area and a second fin receiving area. When detachable insert 1310 is operatively attached to fin box body 1350 in the insert receiving area, the detachable insert cannot be moved in a lateral direction—either forward and back or left and right—more than a de minimis amount. To facilitate and guide the placement of detachable insert 1310 into recess 1360, the recess includes a central alignment slot 1362 along with first and second alignment slots 1364 and 1366. In other embodiments other alignment features can be used in addition to or instead of slots 1362, 1364 and 1366.

Figure 15A:
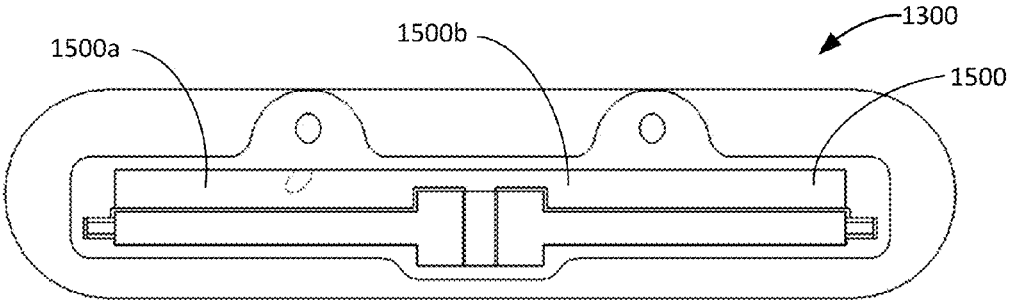
FIG. 15A is a top plan views of the fin box shown in FIG. 13A with the detachable insert set in a fin box in the first position.

Referring back to FIGS. 13A and 13B, detachable insert 1310 can be operatively attached to fin box body 1350 within recess 1360 in two different positions. For example, detachable insert 1310 can be operatively attached to fin box body 1350 by inserting insert 1310 into the insert receiving portion of recess 1360 in a first position shown in FIG. 13A in which feature 1321 is aligned with central slot 1362 and alignment features 1314, 1316 are inserted into first and second alignment slots 1364, 1366, respectively. In this position, feature 1320 extends away from surface 1340*a* of insert 1310 into recess 1360 and seats 1322, 1324 provide an alignment guide for a fin, such as fin 200, so tabs 212 and 214 can be aligned with the seats and inserted within the empty portion of recess 1360 on each side of the seats (i.e., the fin receiving portion of the elongated recess). A top plan view of fin box 1300 with detachable insert attached to fin box body 1350 in this first position is shown in FIG. 15A. Once fin 200 is inserted within the fin receiving portion of recess 1360, the fin can be secured to fin box body 1350 with grub screws (not shown) that extend through angled screw holes 1382 and 1384 and, when tightened, contact and exert a force against tabs 212 and 214, respectively, securing fin 200 to the fin box.

Figure 15B:
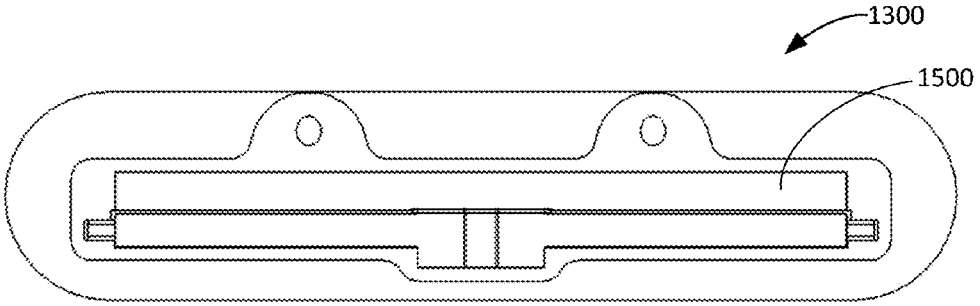
FIG. 15B is a top plan views of the fin box shown in FIG. 15A with the detachable insert set in a fin box in the second position as shown in FIG. 13B.
Figure 15C:
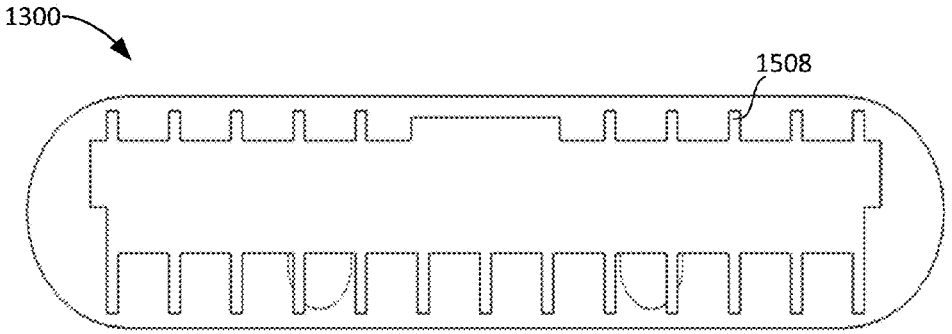
FIG. 15C is a bottom plan view of the fin box shown in FIG. 13A.

Detachable insert 1310 can also be flipped upside down to be switched from the first position to a second position within the insert receiving portion of recess 1360 as shown in FIG. 13B in which feature 1320 is aligned with central slot 1362 and alignment features 1314, 1316 are inserted into first and second alignment slots 1364, 1366, respectively. In this position, feature 1321 extends away from surface 1340*b* of insert 1310 at a bottom portion of recess 1360. In this configuration, the fin receiving portion of recess 1360 is essentially an uninterrupted elongated slot into which a fin, such as fin 300, can be inserted. A top plan view of fin box 1300 with detachable insert attached to fin box body 1350 in this second position is shown in FIG. 15B. Once fin 300 is inserted within the fin receiving portion of recess 1360, the fin can be secured to fin box body 1350 with grub screws (not shown) that extend through angled screw holes 1382 and 1384 and, when tightened, contact and exert a force against fin base 312 securing fin 300 to the fin box.

Fin box body 1350 includes a flange 1370 that surrounds elongated recess 1360 and a raised lip 1372 that extends between flange 1370 and recess 1360. Elongated recess 1360 has a depth that is substantially equal to a height of insert 1310. Thus, when detachable insert 1310 is positioned within recess 1360, either upper surface 1310*a* of the insert or lower surface 1310*b* of the insert, depending on whether the insert is in the first or second position, rests on a bottom surface of recess 1360 while the other of upper surface 1310*a* or lower surface 1310*b* is substantially aligned with lip 1372. Fin box body 1350 further includes a generally rectangular shaped lower portion 1374 similar to portion 474 described above and can be incorporated into a surfboard or other watercraft in substantially the same manner. In some embodiments, lower portion 1374 includes multiple fins 1508 that extend outward from the lower portion to improve adhesion between the fin box and the watercraft the fin box is attached to.

Figure 16:
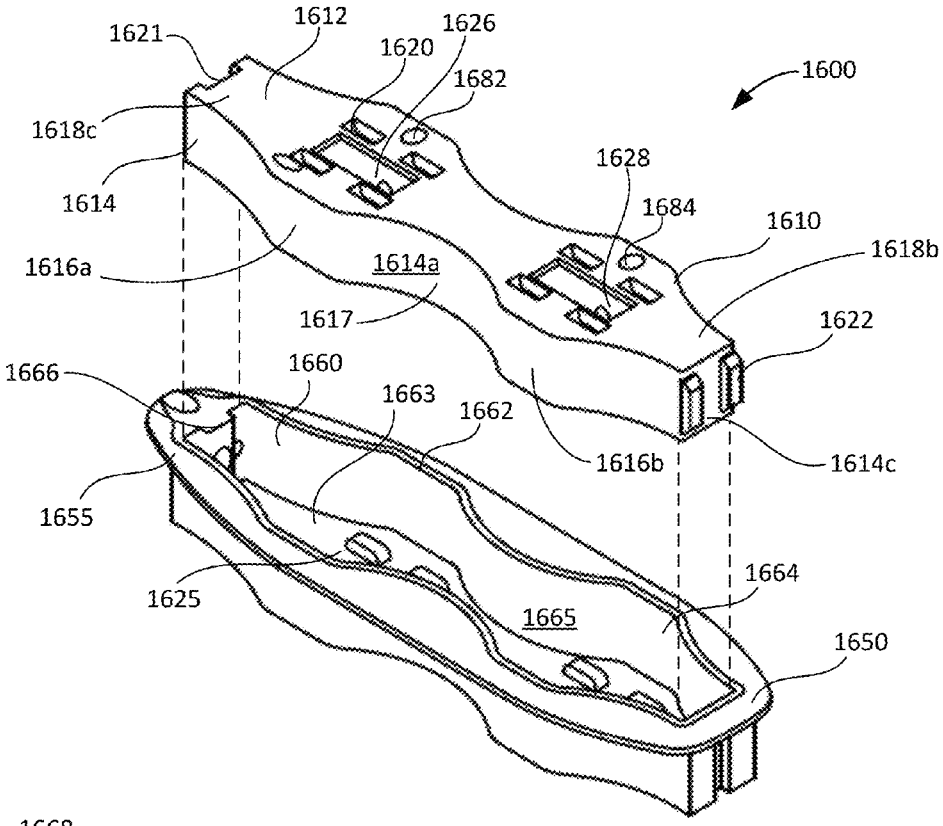
FIG. 16 is a simplified exploded perspective view of a fin box according to an embodiment of the invention with the detachable insert ready to be secured to the fin box in a first position compatible with the fin shown in FIG. 2A.

Reference is now made to FIGS. 16-19, which depict another embodiment of the present disclosure. FIG. 16 is a simplified exploded perspective view of a fin box 1600. Similar to fin box 400, fin box 1600 includes a detachable insert 1610 and a fin box body 1650, each of which can be manufactured or made from a variety of suitable materials, such as a molded plastic or printed on a three-dimensional printer. Detachable insert 1610 has first and second opposing generally planar sides 1612 and 1613 (only side 1612 is visible in FIG. 16) each of which has an elongated hour glass shape that can be inserted into a matching elongated hour glass shaped cavity 1665 of fin box body 1650 in either a first or a second position. In the first position (FIGS. 16 and 17), fin box 1600 is compatible with fins intended for an FCS fin box, such as fin 200. In the second position (FIGS. 18 and 19), fin box 1600 is compatible with fins intended for a Futures fin box, such as fin 300.

A side surface 1614 extends between first and second surfaces 1612 and 1613 defining an outer perimeter of insert 1610. For convenience, first surface 1612 is sometimes referred to herein as an "upper surface" while second surface 1613 is sometimes referred to as a bottom surface of insert 1610. As with other figures within the present disclosure, this nomenclature is for ease of explanation only as which side is physically up and which side is physically down depends on which position (e.g., the first position or the second position) insert 1610 is attached to fin box body 1650 in as well as whether the surfboard or watercraft the fin box body 1650 is formed in is positioned with its fin or fins up or down.

Figure 22A:
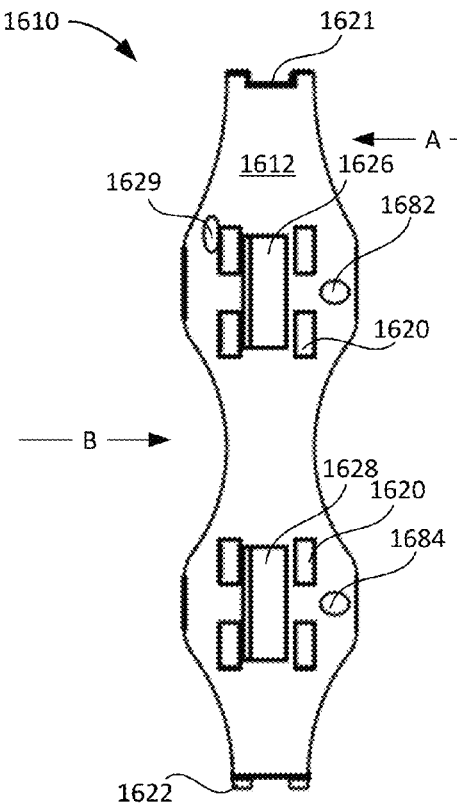
FIGS. 22A and 22B are top and bottom plan views, respectively, of the detachable insert shown in FIGS. 16-19.
Figure 22B:
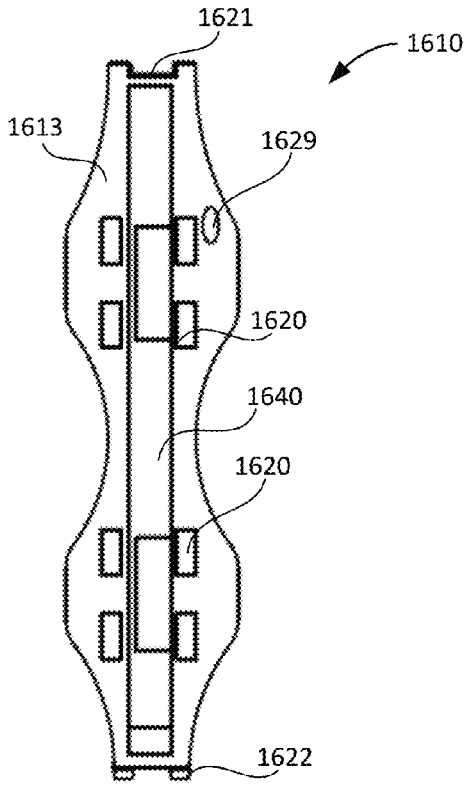

Looking at detachable insert 1610 from either a top or bottom view (e.g., as shown in FIGS. 22A and 22B) insert 1610 has an elongated (e.g., its length is more than twice as long as its width) hour glass shape. Specifically, a central portion 1617 of the insert is thinner (in the width dimension) than first and second bulbous portions 1616*a* and 1616*b* spaced apart from each other on opposite sides of portion 1617. Detachable insert 1610 also includes end portions 1618*a* and 1618*b* that are relatively thin (in the width dimension) compared to bulbous portions 1616*a* and 1616*b* and alignment features 1621 and 1622 formed at ends 1618*a* and 1618*b*, respectively.

As shown in FIG. 16, detachable insert 410 includes first and second apertures 1622 and 1624 open at surface 1612 that extend into the detachable insert towards bottom surface 1613. The apertures 1622, 1624 are spaced apart a predetermined distance and sized and shaped to accept tabs 212, 214 of FCS fin system 200.

Fin box body 1650 includes a central elongated cavity 1660 that has an hour glass shape that generally matches the shape of detachable insert 1610. Elongated cavity 1660 is open at an upper, exterior surface of fin box body 1650 and is sized and shaped to accept detachable insert 1610 such that when the insert is placed within the cavity it cannot be moved in a lateral direction—either forward and back or left and right—more than a de minimis amount. Within elongated cavity 1660 is an alignment rail 1666 at one end of cavity 1660 and a group of feet 1625 at a bottom surface of the cavity. Alignment rail 1666 fits within alignment feature 1621 of detachable insert 1610. Feet 1625 are arranged in two sets of four feet each that are spaced within the two bulbous sections of cavity 1660 and align with openings 1620 of the detachable insert. Thus, when detachable insert 1610 is inserted into fin box body 1650 in the first position, alignment feature 1621 slides over alignment rail 1666 the each of the eight separate openings 1620 align with a respective foot 1625 positioned at bottom surface 1663 of cavity 1660.

Figure 17:
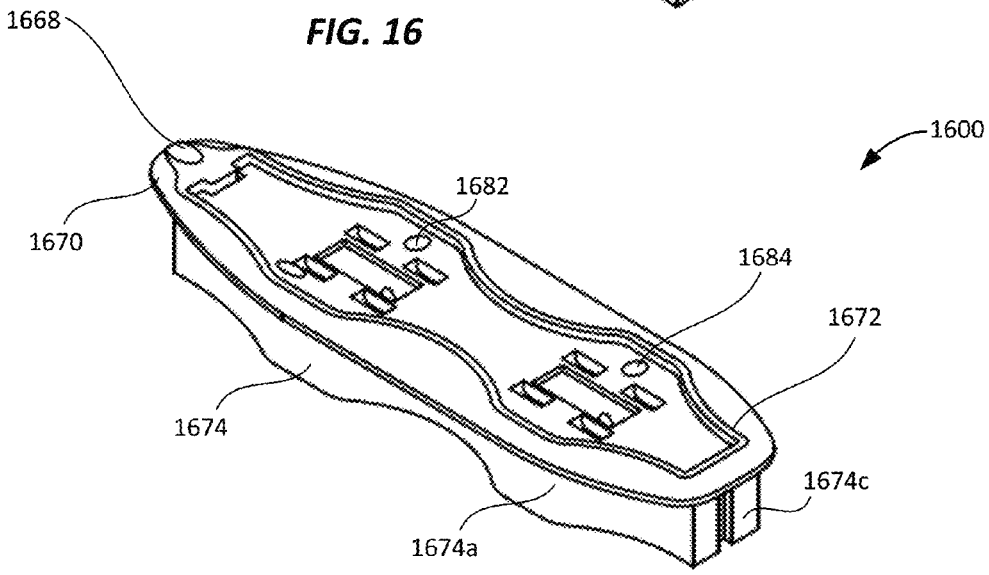
FIG. 17 is a simplified perspective view of the fin box shown in FIG. 16 with the detachable insert secured to the fin box in the first position.

FIG. 17 is a simplified perspective view of detachable insert 1610 insert fitted within elongated cavity 1660 in the first position shown in FIG. 16. Apertures 1626 and 1628 are sized and shaped similar to, and spaced apart the same distance as, apertures 272 and 274. Thus, when the detachable insert is inserted within cavity 1660, fin 200 can be readily mounted and secured to fin box body 1650 by aligning tabs 212 and 214 with apertures 1626 and 1628, respectively, and pushing the fin down into the fin box. Once inserted, fin 200 can then be secured to fin box body 1650 with grub screws (not shown) that extend through angled screw holes 1682 and 1684 and, when tightened, contact and exert a force against tabs 212 and 214, respectively, securing fin 200 to the fin box.

Figure 18:
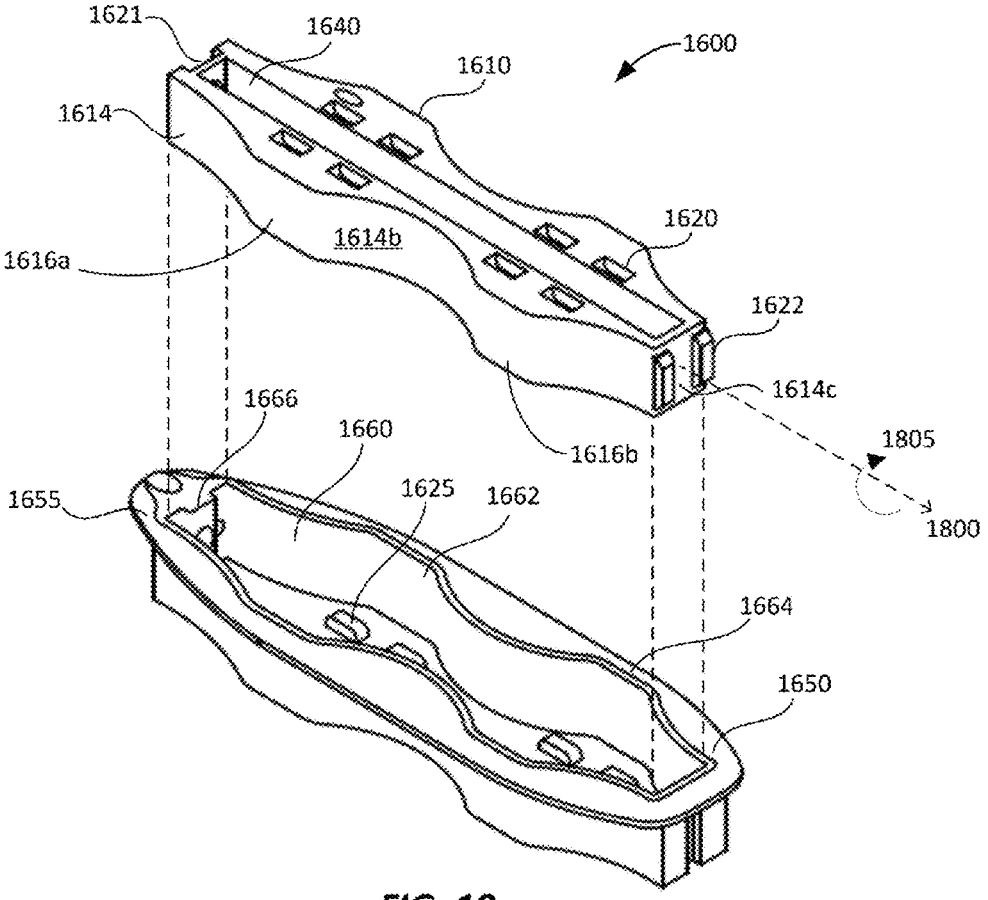
FIG. 18 is a simplified exploded perspective view of a fin box according to an embodiment of the invention with the detachable insert ready to be secured to the fin box in a second position compatible with the fin shown in FIG. 3A.

Detachable insert 1610 can also be inserted and secured to fin box body 1650 in a second position that is compatible with fin 300 shown in FIG. 3A. FIG. 18 is a simplified exploded perspective view of the same fin box 1600 shown in FIG. 16 with detachable insert 1610 ready to be secured to fin box body 1650 in the second position instead of the first position. In the second position, detachable insert 1610 is flipped upside down relative to its position in FIG. 16. That is, insert 1610 is rotated 180 degrees around an axis 1800 as shown by arrow 1805 so that alignment feature 1621 still aligns with rail 1666 and first and second bulbous portions 1616*a*, 1616*b* are still inserted within the same portion of cavity 1665 as in the first portion.

Figure 19:
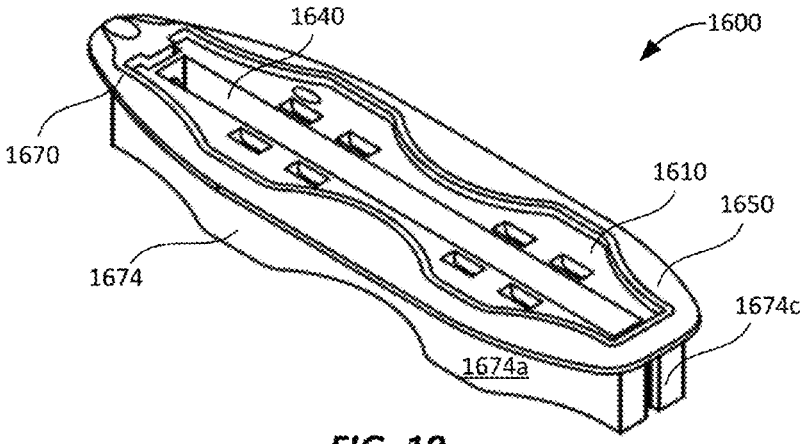
FIG. 19 is a simplified perspective view of the fin box shown in FIG. 16 with the detachable insert secured to the fin box in the second position.

Detachable insert 1610 includes an open elongated slot 1640 that is open at second face 1613 and extends into the insert towards first face 1612. Elongated slot 1640 is side sized and shaped to accept fin blade 310 of fin 300. When the detachable insert is inserted into elongated cavity 1660, elongated slot 1640 is exposed at an upper, exterior surface of fin box body 1650 as shown in FIG. 19. Elongated slot 1640 is sized and shaped similar to elongated slot 362 in FIG. 3B. Thus, when the detachable insert is inserted within cavity 1660 in the second position, fin base 310 of fin 300 fits within elongated slot 1640. A screw (now shown) can then be tightened in angled screw hole 1668 to exert a force against fin base 310 securing fin 300 to the fin box.

As shown in each of FIGS. 16-19, fin box body 1650 includes a flange 1670 that surrounds elongated cavity 1660 and a raised lip 1672 that extends between flange 1670 and cavity 1660. Elongated cavity 1660 has a depth that is substantially equal to a height of insert 1610. Thus, when detachable insert 1610 is positioned within the slot, either upper surface 1612 of the insert or lower surface 1613 of the insert, depending on whether the insert is in the first or second position, rests on a bottom surface 1663 of cavity 1660 while the other of upper surface 1612 or lower surface 1613 is substantially aligned with lip 1672. Fin box body 1650 also includes an hour glass shaped lower portion 1674 that includes first and second opposing side surfaces 1674*a* and 1674*b* (of which only 1674*a* is shown in FIGS. 16-19) that extend along a length of lower portion 1674 and third and fourth opposing side surfaces 1674*c* and 1674*d* (of which only surface 1674*c* is shown in FIGS. 16-19) that extend along a width of the lower portion. Flange 1670 is substantially flat and extends fully around lip 1672 such the flange extends beyond all sides of lower portion 1674.

Fin box body 1650 can be incorporated into a surfboard or other watercraft using any of the techniques described above with respect to fin box body 450.

Figure 20A:
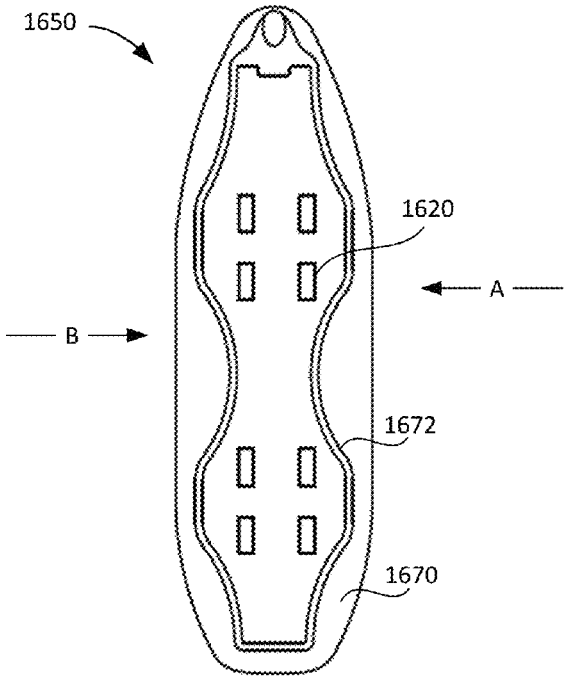
FIGS. 20A and 20B are top and bottom plan views, respectively, of the fin box shown in FIGS. 16-19 without its detachable insert.

FIGS. 20A through 24C are various plan views of the fin box 1600 described above with respect to FIGS. 16-19 showing additional views and angles of various components of the fin box to provide further detail than FIGS. 16-19. Specifically, FIGS. 20A and 20B are top and bottom plan views, respectively, of fin box body 1650 without detachable insert 1610 inserted therein. As shown in FIG. 20A, flange 1670 and lip 1672 each surround central elongated cavity 1660. As shown in FIG. 20B, flange 160 also surrounds lower portion 1674. FIGS. 20C and 20D are left and right side plan views of fin box body 1650 shown in FIGS. 20A and 20B, and FIGS. 20E and 20F are front and rear plan views of the fin box body 1650 shown in FIGS. 20A and 20B. Each of these figures further shows flange 1670 extending outward past the edges of lower portion 1674 along with lip 1672 extending slightly above the flange.

Figure 20B:
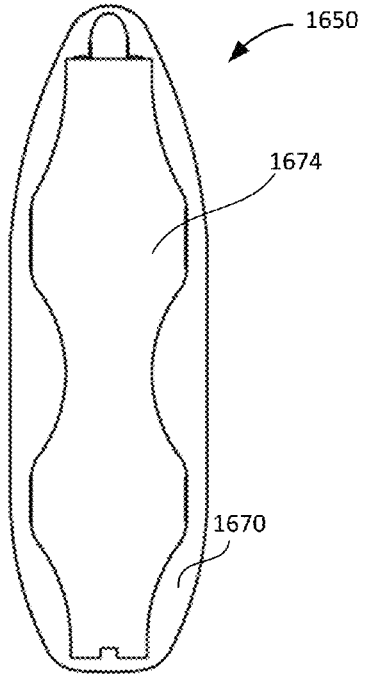
Figure 20C:
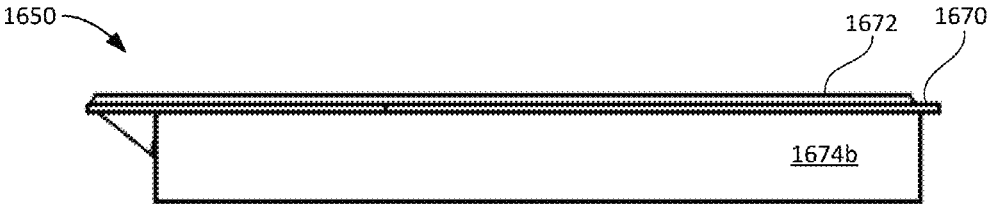
FIGS. 20C and 20D are left and right side plan views of the fin box shown in FIGS. 20A and 20B.
Figure 20D:
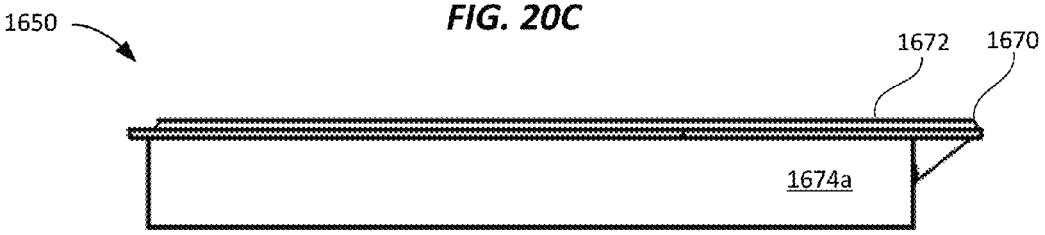
Figure 20E:
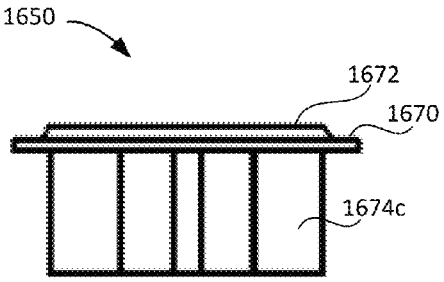
FIGS. 20E and 20F are front and rear plan views of the fin box shown in FIGS. 20A and 20B.
Figure 20F:
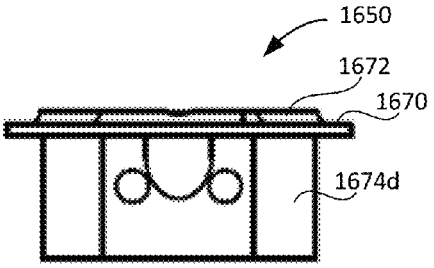
Figure 21A:
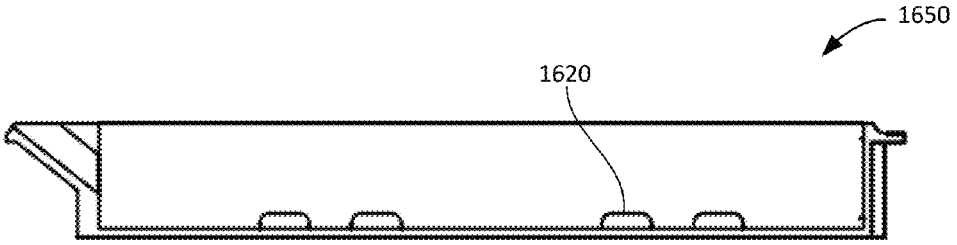
FIG. 21A is a cut-away side plan view of the fin box shown in FIG. 20A looking in direction A.
Figure 21B:
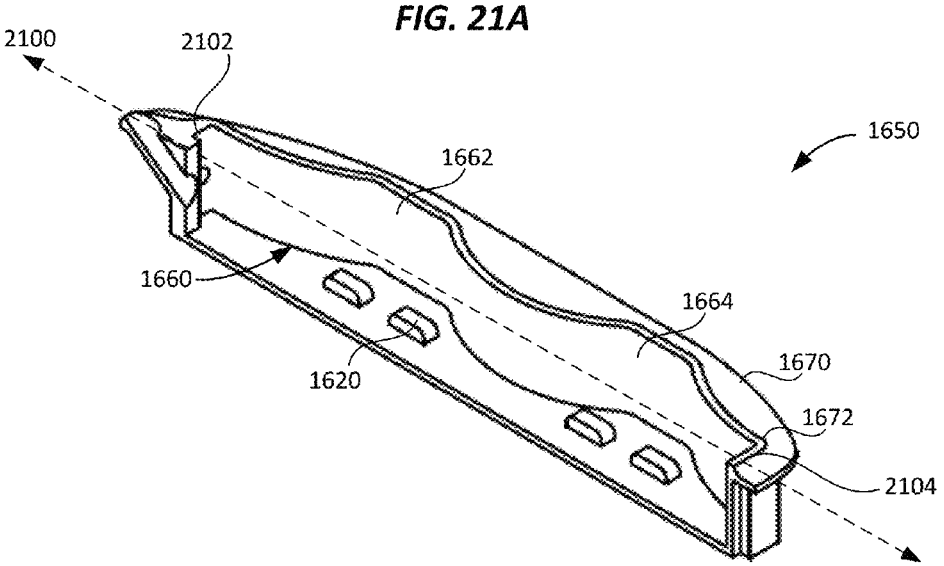
FIG. 21B is a cut-away side perspective views of the fin box shown in FIG. 20A looking in direction A.

FIG. 21A is a cut-away side plan view of the fin box shown in FIG. 20A looking in direction A, while FIG. 20B is a cut-away side perspective view of the fin box shown in FIG. 20A looking in direction A. As shown in FIGS. 21A and 21B, each of the wider, bulbous sections 1662 and 1664 is positioned between a centerline 2100 that bisects the length of cavity 1660 and the first and second ends 2102 and 2104 of the cavity. In other embodiments of the invention, the detachable insert can have a different shape than either the hour glass shape of insert 1610 or the rectangular shape of insert 410 and the fin box cavity can be shaped to match.

Figure 21C:
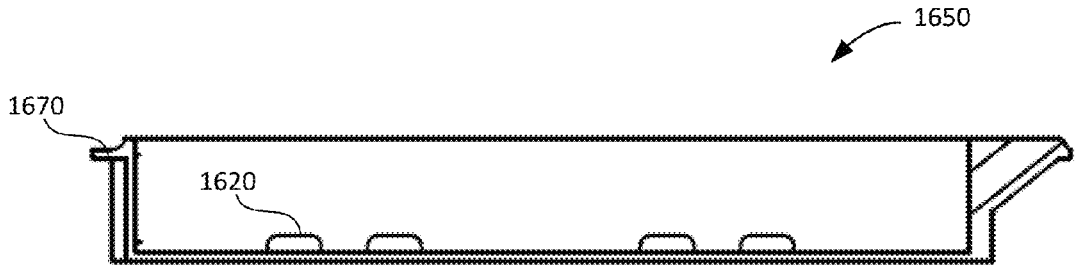
FIG. 21C is a cut-away side plan view of the fin box shown in FIG. 20A looking in direction B.
Figure 21D:
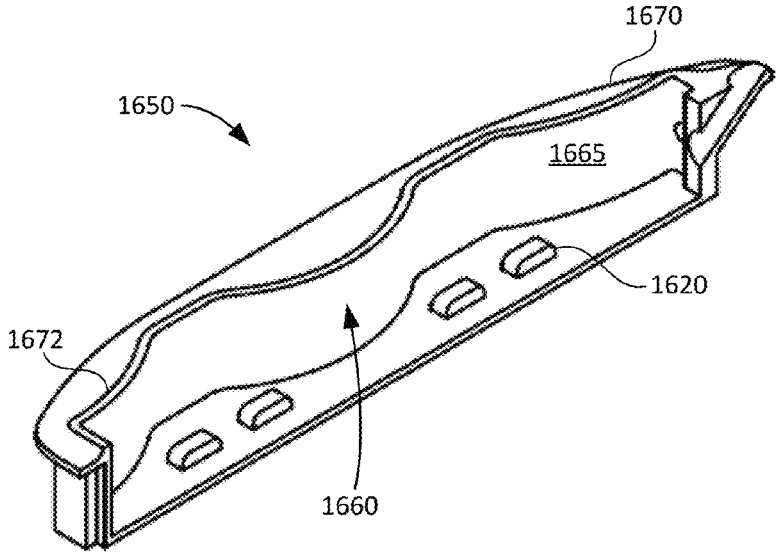
FIG. 21D is a cut-away side perspective views of the fin box shown in FIG. 20A looking in direction B.

FIG. 21C is a cut-away side plan view of the fin box shown in FIG. 20A looking in direction B, while FIG. 21D is a cut-away side perspective views of the fin box shown in FIG. 20A looking in direction B. As shown in FIGS. 21C and 21D, the interior surface 1665 of cavity 1660 on this side can be a substantially flat surface that minimizes the accumulation of sand, dirt or other material within the cavity.

Figure 22C:
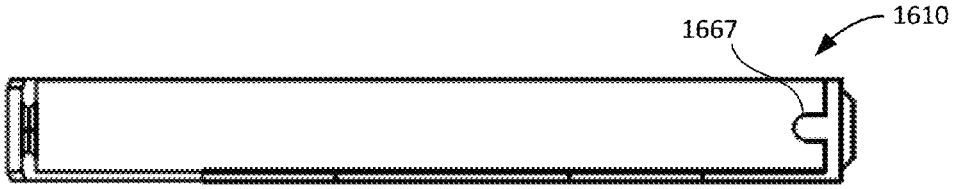
FIG. 22C is a cut-away side plan view of the detachable insert shown in FIG. 22A looking in direction A.
Figure 22D:
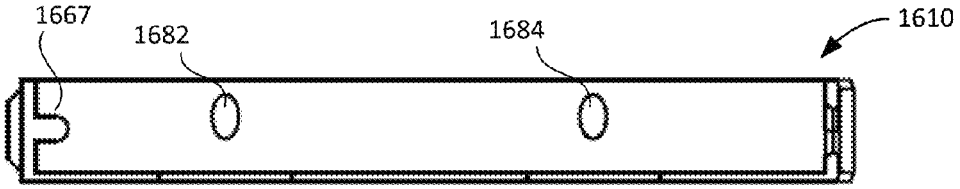
FIG. 22D is a cut-away side plan view of the detachable insert shown in FIG. 2A looking in direction B.

FIGS. 22A and 22B are top and bottom plan views, respectively, of detachable insert 1610 shown in FIGS. 16-19 further apertures 1626 and 1628 formed in upper surface 1612 and elongated slot 1640 formed in lower surface 1613. As previously mentioned, apertures 1626 and 1628 are sized and shaped to accommodate tabs 212 and 214 of fin 200. In other embodiments, where a fin box according to the invention is compatible with a different fin type having tabs of a different size or spacing than tabs 212 and 214, apertures 1626 and 1628 can be sized and spaced as appropriate for the other fin type. Similarly, if a particular fin type has fewer or more than two tabs, insert 1610 may include an appropriate number of apertures formed in surface 1612 or may include another type of alignment mechanism altogether. FIG. 22C is a cut-away side plan view of detachable insert 1610 shown in FIG. 22A looking in direction A, while FIG. 22D is a cut-away side plan view of detachable insert 1610 looking in direction B. In some embodiments of the disclosure, insert 1610 (as well as the other detachable inserts described herein) can include a protrusion 1667 at one end of cavity 1660 similar to pin 366 that is useful for further securing a fin, such as fin 300 shown in FIG. 3A, to the fin box. Specifically, fin 300 can be inserted within elongated slot 1640 such that notch 316 aligns with protrusion 1667 as discussed with respect to FIGS. 3A and 3B to help further secure the fin within elongated slot 1640.

Figure 23A:
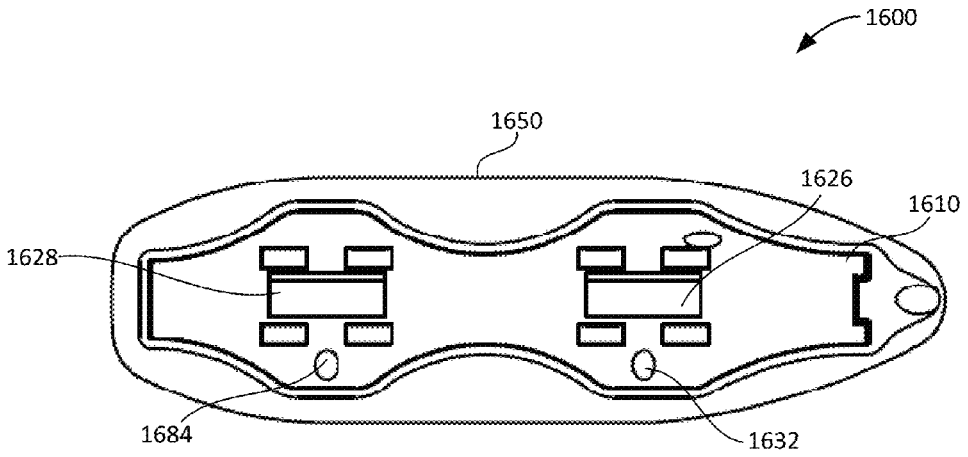
FIG. 23A is a top plan view of the fin box shown in FIGS. 20A-20H with the detachable insert shown in FIGS. 22A-22D inserted in FCS mode according to an embodiment of the invention.
Figure 23B:
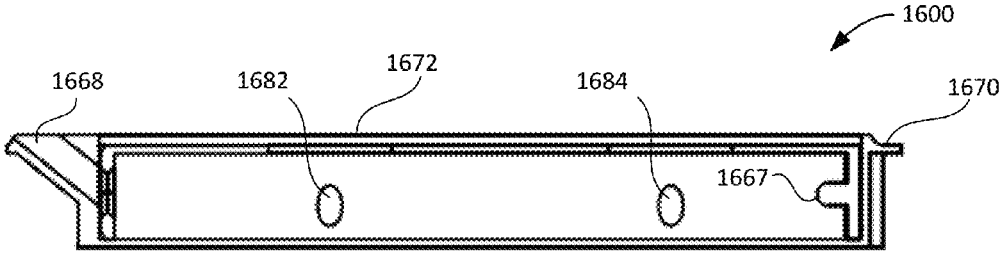
FIG. 23B is a cut-away side plan view of the fin box and detachable insert shown in FIG. 23A looking in direction A.
Figure 23C:
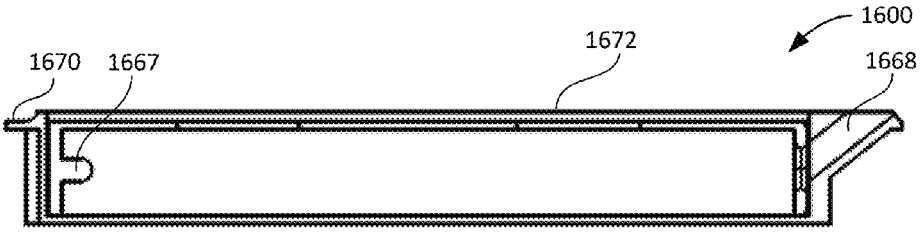
FIG. 23C is a cut-away side plan view of the fin box and detachable insert shown in FIG. 23A looking in direction B.

FIG. 23A is a top plan view of fin box 1600 including fin box body 1650 shown in FIGS. 21A-21D with detachable insert 1610 shown in FIGS. 22A-22D inserted in the first position (FCS mode) according to an embodiment of the invention. FIG. 23B is a cut-away side plan view of the fin box and detachable insert shown in FIG. 23A looking in direction A, and FIG. 23C is a cut-away side plan view of the fin box and detachable insert shown in FIG. 23A looking in direction B.

Figure 24A:
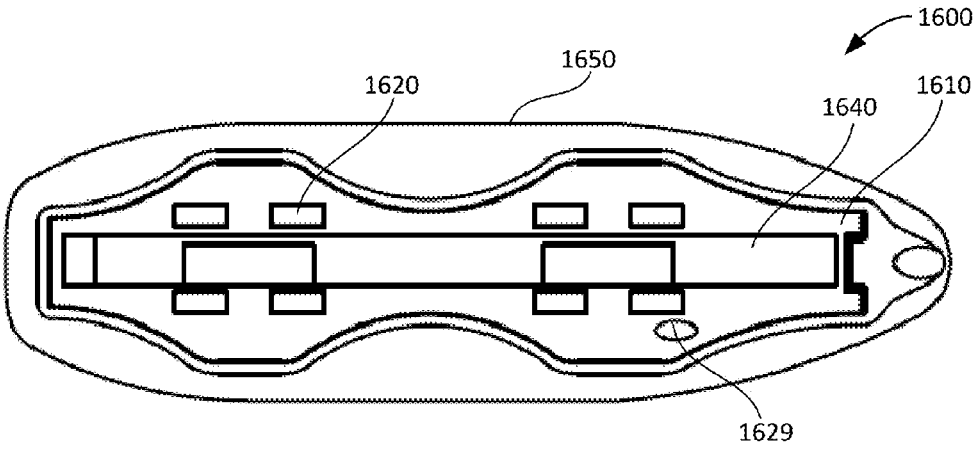
FIG. 24A is a top plan view of the fin box shown in FIGS. 20A-20H with the detachable insert shown in FIGS. 22A-22D inserted in Futures mode according to an embodiment of the invention.
Figure 24B:
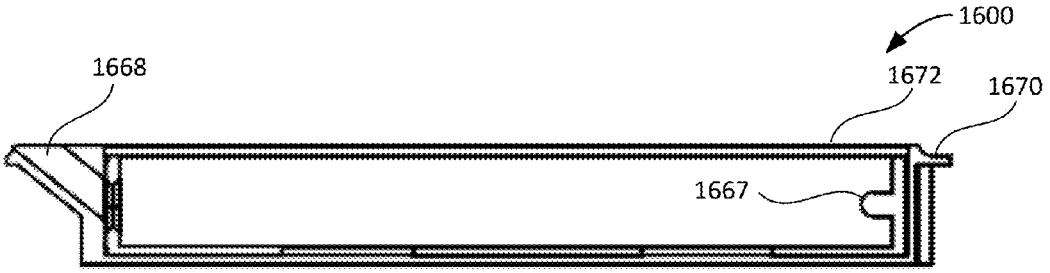
FIG. 24B is a cut-away side plan view of the fin box and detachable insert shown in FIG. 24A looking in direction A.
Figure 24C:
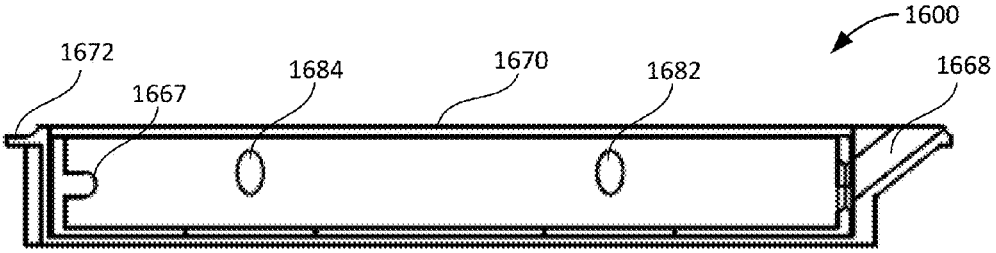
FIG. 24C is a cut-away side plan view of the fin box and detachable insert shown in FIG. 24A looking in direction B.

FIG. 24A is a top plan view of fin box 1600 including fin box body 1650 shown in FIGS. 21A-21D with detachable insert 1610 shown in FIGS. 22A-22D inserted in the second position (Futures mode) according to an embodiment of the invention. FIG. 24B is a cut-away side plan view of the fin box and detachable insert shown in FIG. 24A looking in direction A, and FIG. 24C is a cut-away side plan view of the fin box and detachable insert shown in FIG. 24A looking in direction B.

Figure 25:
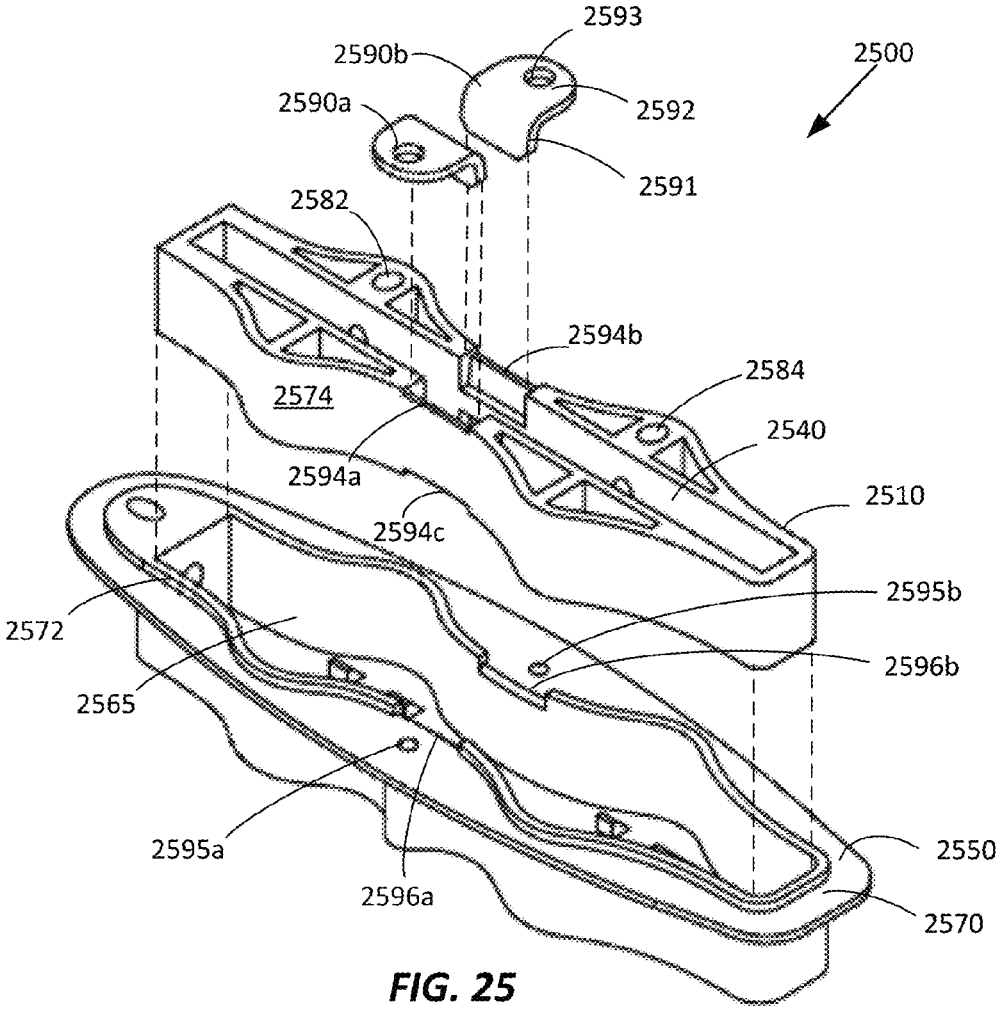
FIG. 25 is a simplified exploded perspective view of a fin box according to another embodiment of the invention with the detachable insert ready to be secured to the fin box in a second position compatible with the fin shown in FIG. 3A.

Reference is now made to FIG. 25, which is a simplified exploded perspective view of a fin box 2500 according to another embodiment of the present disclosure. Similar to fin boxes 400 and 1600, fin box 2500 includes a detachable insert 2510 and a fin box body 2550, each of which can be manufactured or made from a variety of suitable materials, such as a molded plastic or printed on a three-dimensional printer. Detachable insert 2510 is similar to insert 1610 and has an elongated hour glass shape that can be inserted into a matching elongated hour glass shaped cavity 2565 of fin box body 2550 in either a first or a second position. In the first position (not shown), fin box 2500 is compatible with fins intended for an FCS fin box, such as fin 200 and includes two slots (shown in FIG. 27A) that accept tabs 212, 214. In the second position (FIGS. 25 and 26), fin box 2500 is compatible with fins intended for a Futures fin box, such as fin 300, and includes a single elongated slot 2540 that accepts fin base 310.

As evident from a comparison of FIGS. 25 and 26 FIGS. 16-19, many of the features of fin box 2500 are similar to those of fin box 1600 and are thus not described in detail herein. One difference between the embodiments is that fin box 2500 includes a pair of attachment clips 2590*a*, 2590*b* that help secure detachable insert 2510 to fin box body 2550. Each of attachment clips 2590*a*, 2590*b* includes a leg 2591 and a wing 2592 that extends away from the leg. A screw hole 2593 is formed through each wing to enable the respective attachment clip to be secured to fin box body 2550. Towards this end, detachable insert 2510 includes two opposing cut-outs 2594*a*, 2594*b* sized and shaped to accept the leg 2591 at upper surface 2512 (shown in FIG. 25) as well as two similar cut-outs, of which only cut-out 2594*c* is partially shown in FIG. 25, sized and shaped to accept the leg 2591 at the lower surface (not visible in FIG. 25) of detachable insert 2510. Additionally, fin box body 2550 includes first and second screw holes 2995*a*, 2995*b* and first and second lip breaks 2596*a*, 2596*b* where lip 2572 is interrupted.

In operation, each attachment clip can be positioned within its respective cut-out 2594*a*, 2594*b* (or 2594*c*, 2594*d* if the insert is inserted in the first position) so that the leg 2591 is within the cut-out and wing 2592 hangs over an outer wall of the cutout (part of sidewall 2574) across fin box body 2550. In this position, each screw hole 2593 aligns with one of screw holes 2595*a*, 2595*b* so that a screw can secure the attachment clip to the fin box body. Clips 2590*a*, 2590*b* can operate to temporarily secure detachable insert 2510 to fin box body 2550 and redirect outward force caused by the application of grub screws that extend into angled screw holes 2582, 2584 in a way that will not damage the detachable insert 2510, fin box body 2550 or the watercraft the fin box has been installed into.

Figure 26:
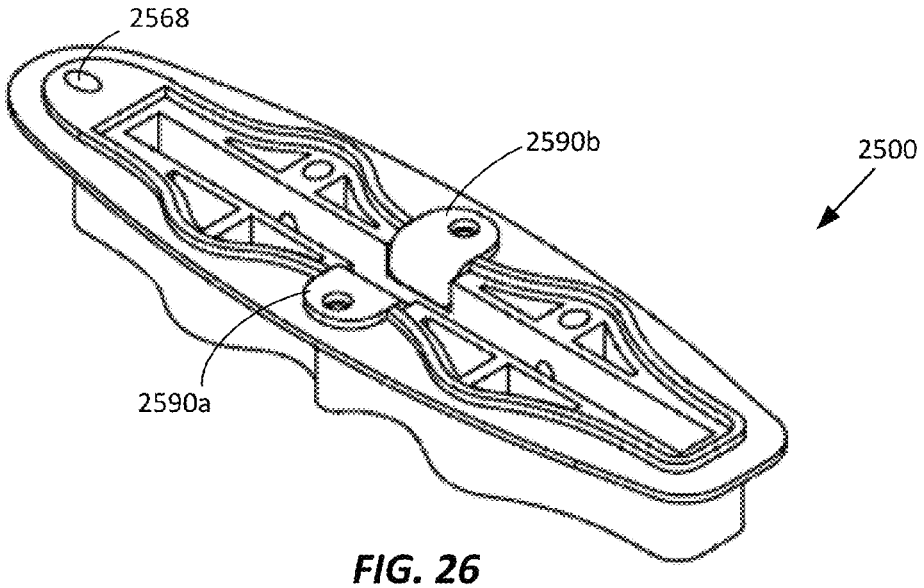
FIG. 26 is a simplified perspective view of the fin box shown in FIG. 25 with the detachable insert secured to the fin box in the second position.
Figure 27A:
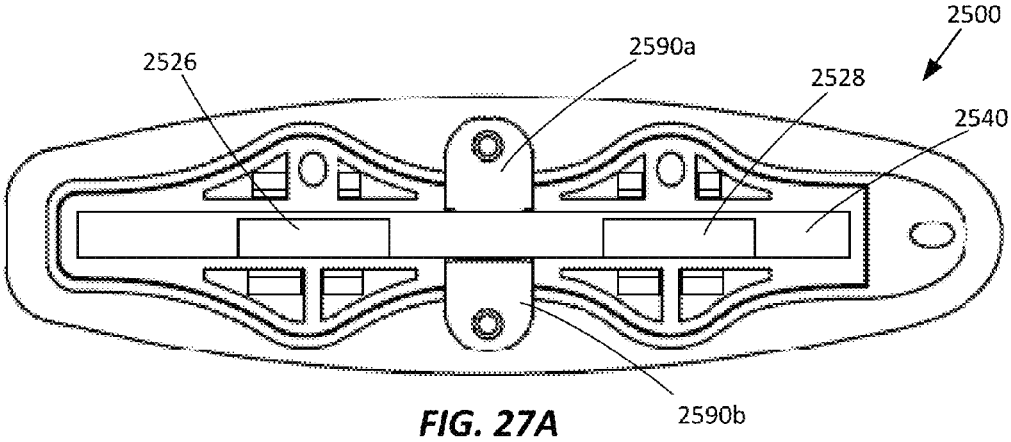
FIG. 27A is a top plan view of the fin box shown in FIG. 25 with the detachable insert in the second position.

FIG. 27A is a top plan view of fin box 2500 with insert 2510 in the second position. As shown in FIG. 27A, however, insert 2510 includes first and second slots 2526, 2528 at the bottom of elongated slot 2540. Slots 2526, 2528 are similar to slots 1626 and 1628 of fin box insert 1610 such that when detachable insert 2510 is positioned within fin box body 2550 in the first position (upside down from what is shown in FIGS. 25, 26 and 27A), slots 2526, 2528 are at the upper surface of the insert and can accept tabs 212, 214 of fin 200.

Figure 27B:
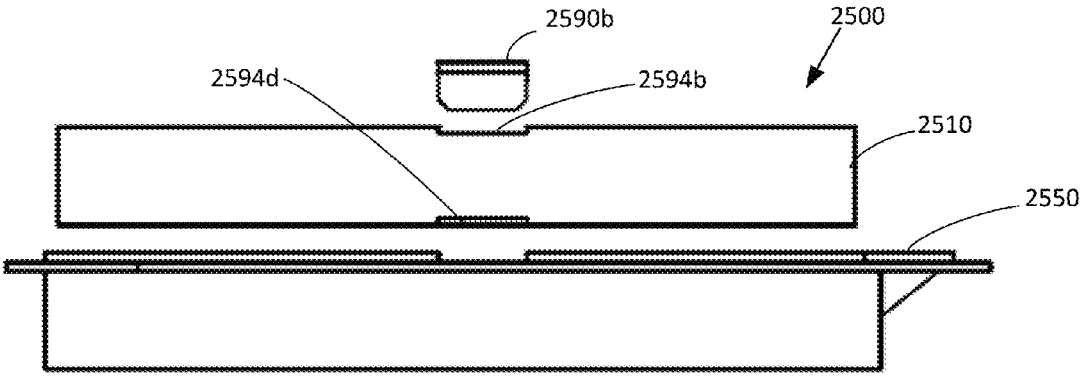
FIGS. 27B and 27C are side and front plan views, respectively, of the fin box shown in FIGS. 25 and 26.
Figure 27C:
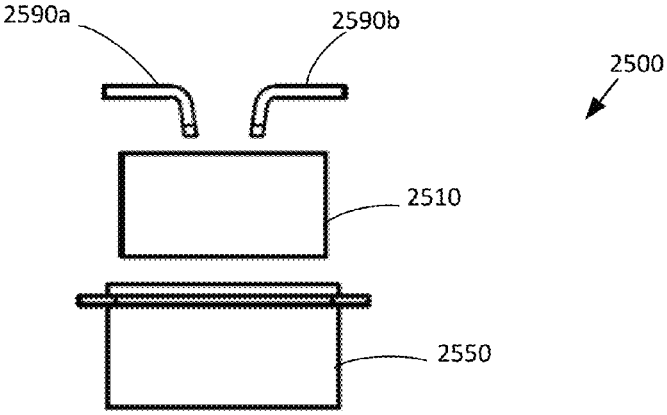
Figure 28A:
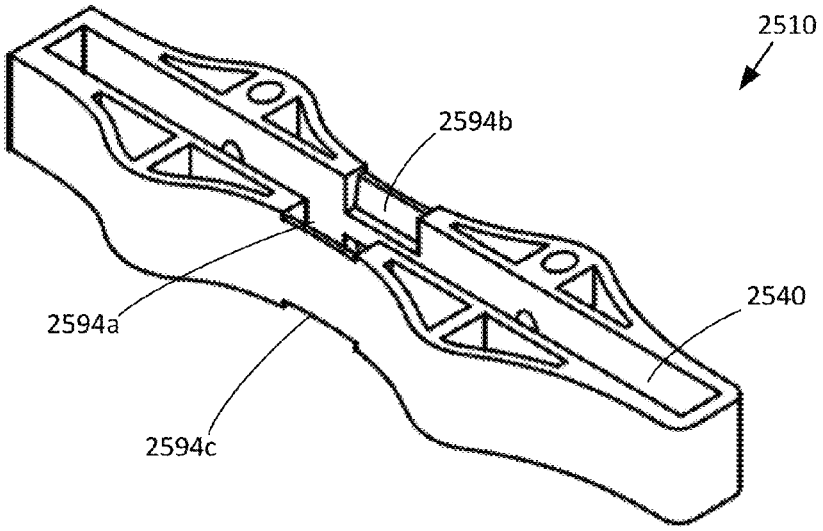
FIGS. 28A, 28B and 28C are simplified perspective, top plan and side cross-sectional views, respectively, of the detachable insert shown in FIGS. 25 and 26.
Figure 28B:
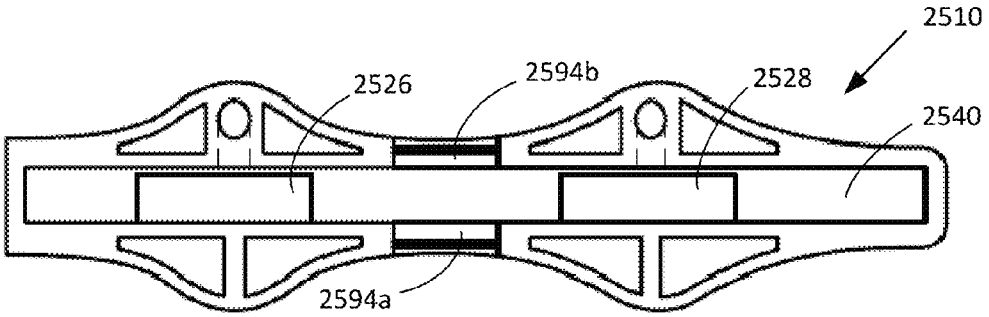
Figure 28C:
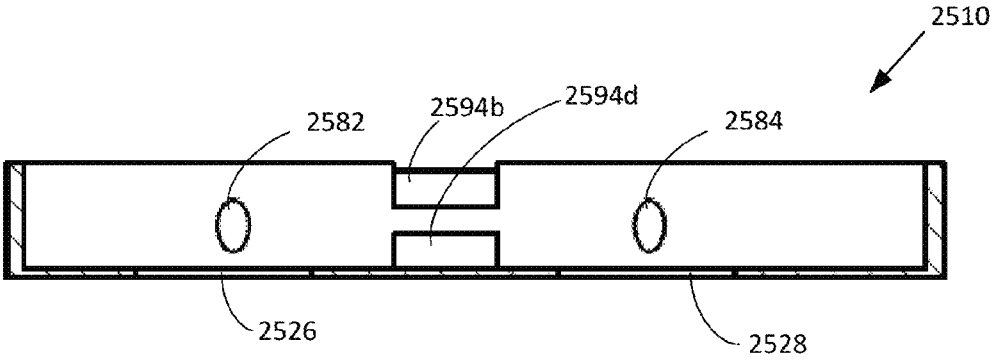
Figure 29:
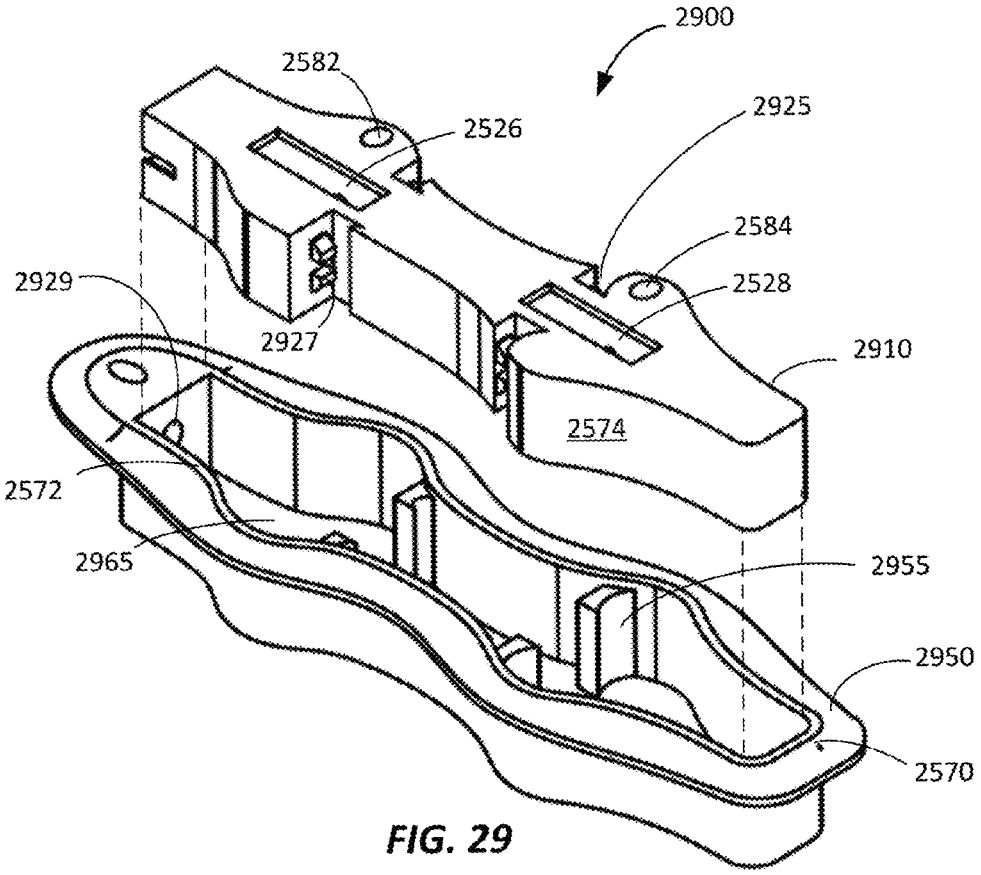
FIG. 29 is a simplified exploded perspective view of a fin box according to another embodiment of the invention with the detachable insert ready to be secured to the fin box in a first position compatible with the fin shown in FIG. 2A.
Figure 30:
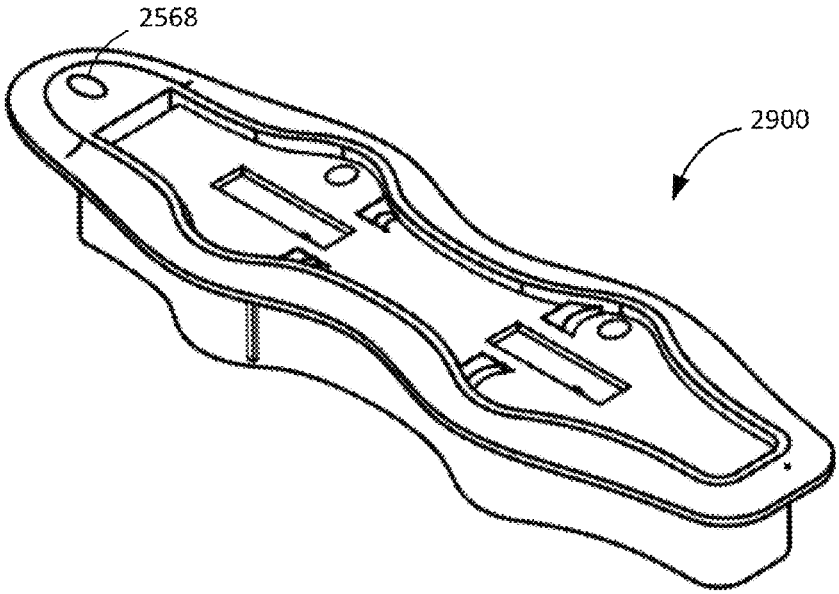
FIG. 30 is a simplified perspective view of the fin box shown in FIG. 29 with the detachable insert secured to the fin box in the first position.
Figure 31:
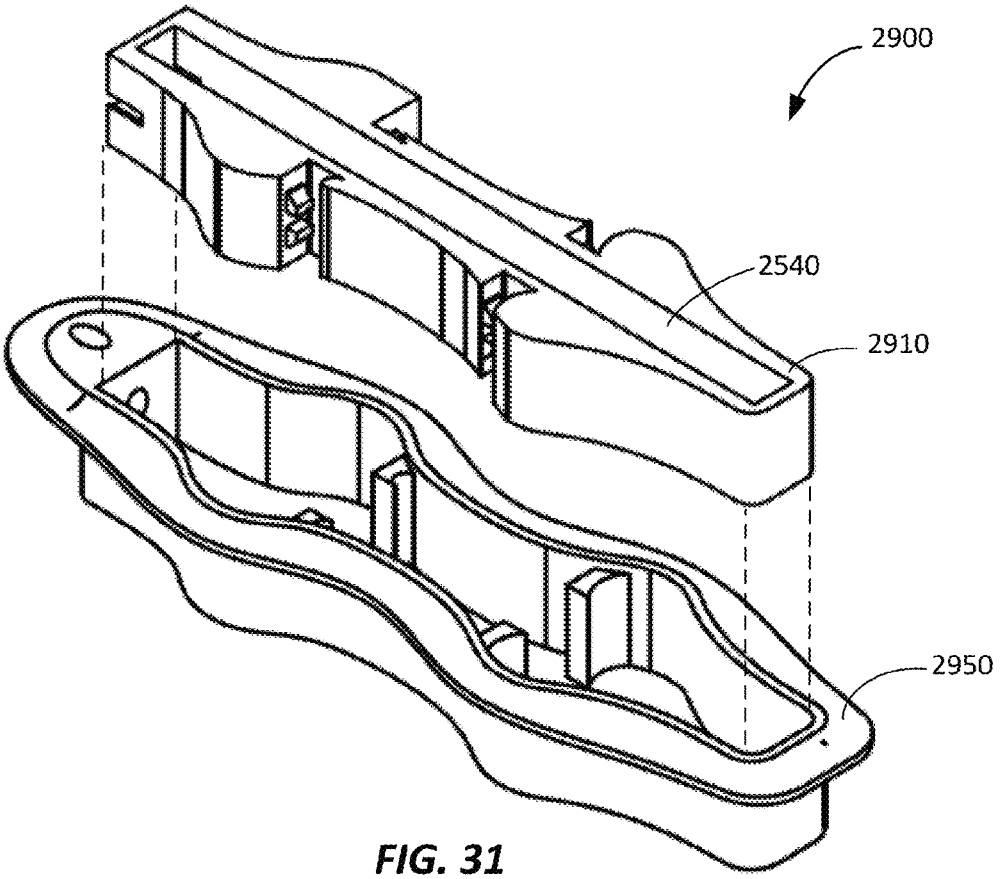
FIG. 31 is a simplified exploded perspective view of the fin box shown in FIG. 29 with the detachable insert ready to be secured to the fin box in a second position compatible with the fin shown in FIG. 3A.
Figure 32:
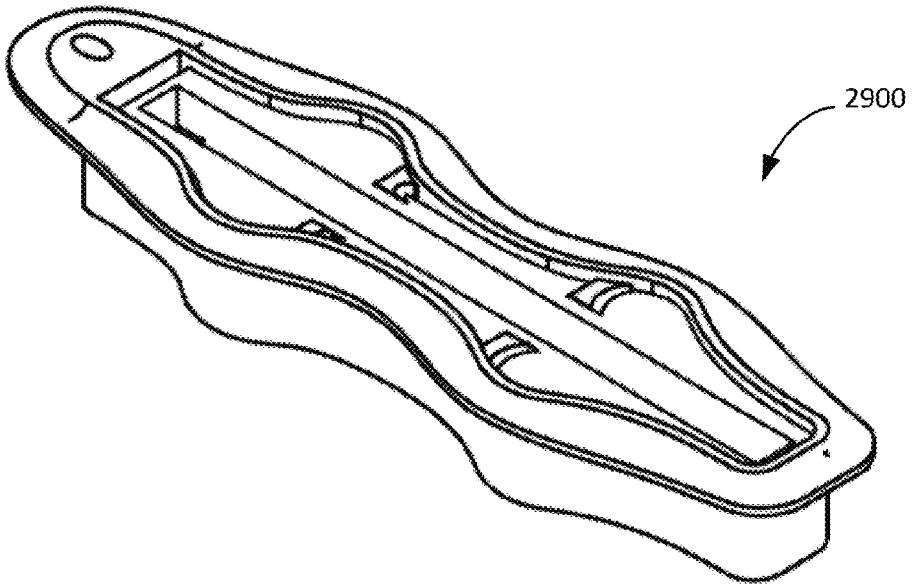
FIG. 32 is a simplified perspective view of the fin box shown in FIG. 31 with the detachable insert secured to the fin box in the second position.

FIGS. 27B and 27C are side and front plan views, respectively, of fin box 2500 shown in FIGS. 25 and 26. In FIGS. 27B, 27C detachable insert 2510 is positioned above fin box body 2550 and attachable clips 2590*a*, 2590*b* are positioned above detachable insert 2510. Thus, the detachable insert is in a position in which it is ready to be inserted into the cavity of fin box body 2550 and the attachment clips are in a position in which they are ready to be attached to the fin box body to further secure detachable insert 2510 to body 2550. FIGS. 28A, 28B and 28C are simplified perspective, top plan and side cross-sectional views, respectively, of detachable insert 2510 shown in FIGS. 25 and 26.

In the embodiment illustrated in FIGS. 25-28C, attachment clips 2590*a*, 2590*b* are identical to each other and thus interchangeable. Other embodiments of the disclosure, however, can include attachment clips that differ in one or more ways and are thus designed to be coupled to a particular side of the fin box system or a particular orientation of the detachable insert.

FIGS. 29-32 are simplified perspective views of a fin box 2900 according to another embodiment of the invention. Fin box 2900 includes a detachable insert 2910 and a fin box body 2950 and is similar to fin box 2500. To avoid unnecessarily repeating information from previously described fin box embodiments, elements common to the embodiments are not described herein. In some instances, the same reference numbers previously used in conjunction with fin box 2500 are included in one or more of FIGS. 29-32 to indicate like elements, but a person of skill in the art will readily appreciate that other elements of fin box 2900 can be similar to elements of fin box 2500 or fin box 1600 even though the elements are not called out by a specific reference number.

Similar to fin box 2500, detachable insert 2910 can be inserted into and secured to fin box body 2950 in either a first position (FIGS. 29, 30) in which fins made for the FCS fin box can be used with the fin box (e.g., fin 200) or a second position (FIGS. 31, 32) in which fins made for the Futures fin box can be used with the fin box (e.g., fin 300). In both configurations detachable insert 1310 is inserted within a portion of a recess 2965 formed in body 2950 as shown in the figures.

One difference between fin box 2900 and fin box 2500 is that fin box 2900 includes additional alignment features 2925 of detachable insert 2910 that mate with corresponding alignment features 2955 within fin box body 2950. Additionally, a spring plunger (not shown) can extend through a seat 2929 to bias detachable insert 2910 towards the opposite end of caviry 2965. The spring plunger can push protrusions 2927 on insert 2910 into matching cavities (not shown) in fin box body 2950 to help secure the detachable insert and prevent it from bending upward when pressure is applied by a grub screw that extends through angled screw hole 2568.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

Also, as used herein, spatially relative terms, such as "upper", "bottom", "above", "lower" and the like may be used to describe an element and/or feature's relationship to another element(s) and/or feature(s) as, for example, illustrated in the figures. It will be understood that the spatially relative terms are intended to encompass different orientations of the described device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

What is claimed is:

1. A fin box for a watercraft, the fin box comprising:

a body with an elongated cavity open at an exterior surface;

a detachable insert configured to be inserted within the elongated cavity in a first position and a second position different than the first position, wherein when the insert is inserted in the first position a fin having a fin base operable with a first fin system can be attached and secured to the fin box, and when the insert is inserted in the second position a fin having a fin base operable with a second fin system incompatible with the first fin system can be attached and secured to the fin box.

2. The fin box set forth in claim 1 wherein when the detachable insert is in the second position, the insert is rotated 180 degrees with respect to when the insert is in the first position.

3. The fin box set forth in claim 1 wherein:

the detachable insert includes first and second planar opposing sides extending in a length and width directions of the insert, each of the first and second planar sides having an hour glass shape; and the elongated cavity of the fin box body has an hour glass shape that accommodates the detachable insert.

4. The box set forth in claim 3 wherein the first side of the detachable insert includes first and second apertures formed in a first surface and the second side of the detachable insert including an elongated slot extending along a length of the second side.

5. The fin box set forth in claim 4 wherein:

the detachable insert includes first and second cut-outs centered along the length of the insert on opposite sides of the elongated slot;

the fin box body further comprises first and second screw holes centered along a length of the fin box body on opposites sides of the elongated cavity; and the fin box further comprises first and second clips, each clip having a leg that is sized and shaped to fit within one of the cut-outs and a wing that includes a screw hole that aligns with one of the first and second screw holes when the leg of the clip is inserted into one of the cutouts.

6. The fin box set forth in claim 1 wherein:

the detachable insert is generally rectangular in shape with a length, a width and a height, and includes first and second opposing sides extending in the length and width directions, the first side including first and second apertures formed in a first surface and the second side including an elongated slot extending along a length of the second side;

wherein the fin box body further comprises first and second rails extending along an interior sidewall of the elongated cavity perpendicular to the opening and the detachable insert includes first and second channels that align with the first and second rails in both the first and second positions; and the first channel opens to the first aperture and the second channel opens to the second aperture.

7. The fin box set forth in claim 1 wherein the fin box body includes a flange having a generally planar surface surrounding the elongated cavity.

8. The fin box set forth in claim 1 wherein the fin box body further comprises a raised lip extending between the flange and the elongated cavity.

9. The fin box set forth in claim 1 wherein the first position is compatible with FCS fins and the second position is compatible with Futures fins.

10. The fin box set forth in claim 1 wherein the detachable insert has a plurality of openings positioned on exterior sidewalls to facilitate removal of the detachable insert from the elongated cavity.

11. A fin box for a watercraft, the fin box comprising:

a body having an elongated cavity open at an exterior surface, a flange having a generally planar surface surrounding the elongated cavity, and a raised lip extending between the flange and the elongated cavity; and a detachable insert having a length, a width and a height, the detachable insert including top and bottom opposing sides extending in the length and width directions and a sidewall extending between the top and bottom opposing sides, the sidewall including first and second opposing surfaces extending in the length and height directions and third and fourth opposing surfaces extending in the width and height directions, wherein the top side includes first and second apertures formed in a top surface, the bottom side includes an elongated slot extending along a length of the bottom side;

wherein the detachable insert is configured to be inserted within the elongated cavity in a first position in which a fin having a fin base operable with a first fin system can be attached and secured to the fin box, and a second position different than the first position in which a fin having a fin base operable with a second fin system incompatible with the first fin system can be attached and secured to the fin box.

12. The fin box set forth in claim 11 wherein the elongated cavity and the detachable insert each have complimentary hour glass profiles.

13. The fin box set forth in claim 11 further comprising first and second attachment clips, each of the first and second attachment clips having a leg, a wing that extends away from the leg and a hole extending through the wing.

14. The fin box set forth in claim 11 wherein the first position is compatible with FCS fins and the second position is compatible with Futures fins.

15. A fin box for a watercraft, the fin box comprising:

a detachable insert;

a body including a generally planar exterior surface and a recess formed in the body, the recess including a fin receiving portion configured to accept a fin base and an insert receiving portion adjacent to the fin receiving portion and configured to receive the detachable insert in a first position and a second position, wherein when the insert is in the first position a fin having a fin base operable with a first fin system can be inserted into the fin receiving portion of the recess and secured within the fin box and when the insert is in the second position a fin having a fin base operable with a second fin system incompatible with the first fin system can be inserted into the fin receiving portion of the recess and secured within the fin box.

16. The fin box set forth in claim 15 wherein the fin receiving portion of the recess comprises an elongated slot.

17. The fin box set forth in claim 15 wherein the body includes a lip that extends above the generally planar surface around a perimeter of the recess.

18. The fin box set forth in claim 15 wherein the recess includes first and second opposing recess sidewalls that extend along a length of the recess, a third recess sidewall extending between the first and second opposing recess sidewalls, a fourth recess sidewall opposite the third recess sidewall and extending between the first and second opposing recess sidewalls; and a bottom recess surface that extends between the first, second, third and fourth recess sidewalls.

19. The fin box set forth in claim 15 wherein the insert has first and second opposing insert sidewalls that extend along a length of the insert and top and bottom insert surfaces that extend between the first and second opposing insert sidewalls, and wherein when the insert is in the first position, the first insert sidewall is adjacent to the first recess sidewall and the bottom insert surface is adjacent to the bottom recess surface, and when the insert is in the second position, the first insert sidewall is adjacent to the first recess sidewall and the top insert surface is adjacent to the bottom recess surface.

20. The fin box set forth in claim 15 wherein the insert is configured to be flipped upside down to be switched from the first position to the second position.

* * * * *